US008657700B2

(12) United States Patent
Nicolette et al.

(10) Patent No.: US 8,657,700 B2
(45) Date of Patent: Feb. 25, 2014

(54) CLUB HEAD SETS WITH VARYING CHARACTERISTICS AND RELATED METHODS

(75) Inventors: Michael R. Nicolette, Scottsdale, AZ (US); Bradley D. Schweigert, Anthem, AZ (US); Marty R. Jertson, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 477 days.

(21) Appl. No.: 12/791,740

(22) Filed: Jun. 1, 2010

(65) Prior Publication Data

US 2010/0279796 A1 Nov. 4, 2010

Related U.S. Application Data

(63) Continuation-in-part of application No. 11/828,260, filed on Jul. 25, 2007, now abandoned.

(60) Provisional application No. 61/323,349, filed on Apr. 12, 2010.

(51) Int. Cl.
*A63B 53/00* (2006.01)
*A63B 55/00* (2006.01)

(52) U.S. Cl.
USPC ..... 473/291; 473/290; 473/332; 473/349; 473/350; D21/748; D21/747

(58) Field of Classification Search
USPC ..... 473/290–291, 349, 350, 334–339, 332; D21/747–749
See application file for complete search history.

(56) References Cited

U.S. PATENT DOCUMENTS

| | | | | | |
|---|---|---|---|---|---|
| D55,278 | S | | 5/1920 | Kraeuter | |
| 2,087,685 | A | * | 7/1937 | Hackney | 473/349 |
| 3,059,926 | A | * | 10/1962 | Johnstone | 473/291 |
| 3,138,386 | A | | 6/1964 | Onions | |
| 3,429,576 | A | | 2/1969 | Ikeda | |
| 3,845,955 | A | * | 11/1974 | Solheim | 473/226 |
| D234,608 | S | | 3/1975 | Raymont | |
| 3,955,820 | A | | 5/1976 | Cochran et al. | |
| D240,841 | S | | 8/1976 | Solheim | |
| 3,979,122 | A | | 9/1976 | Belmont | |
| 3,995,865 | A | | 12/1976 | Cochran et al. | |
| 4,200,286 | A | * | 4/1980 | Bennett | 473/291 |
| D256,264 | S | | 8/1980 | Solheim | |

(Continued)

FOREIGN PATENT DOCUMENTS

| | | |
|---|---|---|
| GB | 2403659 | 2/2007 |
| GB | 2403659 B | 2/2007 |

(Continued)

OTHER PUBLICATIONS

Ralph Maltby, Golf Club Design, Fitting, Alteration, & Repair, Jan. 1995, Ralph Maltby Enterprises, Inc., 4th Edition, p. 508.*

(Continued)

*Primary Examiner* — Gene Kim
*Assistant Examiner* — Matthew B Stanczak

(57) ABSTRACT

Embodiments of golf clubs head sets with varying characteristics are disclosed herein. Other examples and related methods are also generally described herein.

27 Claims, 17 Drawing Sheets

(56) References Cited

U.S. PATENT DOCUMENTS 4,340,230 A 7/1982 Churchward
4,355,808 A 10/1982 Jernigan et al.
4,420,156 A 12/1983 Campau
D276,644 S 12/1984 Solheim
4,715,601 A 12/1987 Lamanna
4,754,977 A 7/1988 Sahm
4,826,172 A * 5/1989 Antonious ..... 473/350
4,848,747 A 7/1989 Fujimura et al.
4,921,252 A 5/1990 Antonious
4,938,470 A * 7/1990 Antonious ..... 473/242
5,011,151 A 4/1991 Antonious
5,014,993 A * 5/1991 Antonious ..... 473/350
5,026,056 A * 6/1991 McNally et al. ..... 473/291
5,048,834 A 9/1991 Gorman
5,048,835 A * 9/1991 Gorman ..... 473/350
5,056,788 A 10/1991 Katayama
D329,266 S * 9/1992 Antonious ..... D21/749
D330,577 S 10/1992 Solheim
D331,272 S * 11/1992 Antonious ..... D21/749
D332,478 S * 1/1993 Antonious ..... D21/749
D332,812 S 1/1993 Solheim
D333,333 S 2/1993 Solheim
5,193,805 A 3/1993 Solheim
D344,778 S 3/1994 Solheim
5,290,032 A * 3/1994 Fenton et al. ..... 473/290
5,312,105 A 5/1994 Cleveland
5,328,184 A 7/1994 Antonious
5,335,914 A 8/1994 Long
5,356,138 A * 10/1994 Chen et al. ..... 473/291
5,377,985 A * 1/1995 Ohnishi ..... 473/324
5,385,348 A 1/1995 Wargo
5,390,924 A * 2/1995 Antonious ..... 473/328
5,395,113 A * 3/1995 Antonious ..... 473/324
D357,294 S 4/1995 Solheim
5,413,336 A 5/1995 Iwanaga
5,435,559 A 7/1995 Swisshelm
D368,127 S 3/1996 Solheim
5,524,880 A 6/1996 Kobauashi
5,547,188 A 8/1996 Dumontier et al.
5,547,194 A * 8/1996 Aizawa et al. ..... 473/350
5,549,297 A * 8/1996 Mahaffey ..... 473/290
D379,393 S 5/1997 Kubica et al.
5,629,475 A 5/1997 Chastonay
5,643,103 A 7/1997 Aizawa
5,643,107 A 7/1997 Gorman
D383,819 S 9/1997 Takahashi et al.
5,665,013 A 9/1997 Kobayashi
5,669,826 A * 9/1997 Chang et al. ..... 473/332
5,674,133 A * 10/1997 Chang et al. ..... 473/291
5,676,605 A 10/1997 Kobayashi
D386,550 S 11/1997 Wright et al.
D386,551 S 11/1997 Solheim et al.
D387,405 S 12/1997 Solheim et al.
D388,486 S 12/1997 Mahaffey
5,695,411 A 12/1997 Wright et al.
D390,617 S 2/1998 Solheim et al.
D392,356 S 3/1998 Burrows
5,792,005 A * 8/1998 Sieleman et al. ..... 473/349
D398,687 S 9/1998 Miyajima et al.
5,813,919 A 9/1998 Best et al.
5,842,934 A * 12/1998 Ezaki et al. ..... 473/342
D411,272 S 6/1999 Burrows
5,921,869 A 7/1999 Blough et al.
5,971,868 A * 10/1999 Kosmatka ..... 473/349
5,984,803 A 11/1999 Chappell
D418,184 S 12/1999 Kubica
6,015,354 A * 1/2000 Ahn et al. ..... 473/256
6,027,415 A * 2/2000 Takeda ..... 473/291
D421,784 S 3/2000 Kubica
D422,043 S 3/2000 Kubica et al.
6,077,171 A 6/2000 Yoneyama
6,077,173 A * 6/2000 Stites ..... 473/334
D428,635 S 7/2000 Nagai et al.
D429,298 S 8/2000 Butler
D429,299 S 8/2000 Kubica et al.
D437,902 S 2/2001 Persinger
D437,906 S 2/2001 Gilbert
6,183,376 B1 2/2001 Peters et al.
6,206,790 B1 3/2001 Kubica et al.
6,210,290 B1 4/2001 Erickson et al.
D442,659 S 5/2001 Kubica et al.
D443,008 S 5/2001 Kubica et al.
D444,195 S 6/2001 Wahl et al.
D445,157 S 7/2001 Jones et al.
6,267,691 B1 * 7/2001 Dammen ..... 473/329
6,290,607 B1 9/2001 Gilbert et al.
6,290,608 B2 * 9/2001 Gates ..... 473/292
D453,949 S 2/2002 Helmstetter et al.
D456,056 S 4/2002 Bakke
D458,328 S 6/2002 Solheim et al.
6,450,897 B2 * 9/2002 Stites et al. ..... 473/334
6,454,665 B2 9/2002 Antonious
D465,253 S 11/2002 Best
6,482,104 B1 * 11/2002 Gilbert ..... 473/287
D473,605 S 4/2003 Petersen et al.
D475,108 S 5/2003 Madore
6,592,469 B2 7/2003 Gilbert
6,595,870 B2 7/2003 Stites et al.
6,599,202 B2 7/2003 Miyamoto
D480,440 S 10/2003 Rollinson et al.
6,695,714 B1 2/2004 Bliss et al.
6,709,345 B2 3/2004 Iwata et al.
D492,376 S 6/2004 Nicolette et al.
D494,240 S 8/2004 Schweigert
D494,648 S 8/2004 Schweigert et al.
6,773,361 B1 * 8/2004 Lee ..... 473/335
6,776,723 B2 8/2004 Bliss et al.
6,811,496 B2 11/2004 Wahl et al.
D500,350 S 12/2004 Schweigert et al.
D500,351 S 12/2004 Schweigert et al.
6,830,519 B2 12/2004 Reed et al.
6,832,962 B2 12/2004 Stites et al.
D502,237 S 2/2005 Schweigert et al.
6,855,066 B2 2/2005 Best
D502,975 S 3/2005 Schweigert et al.
D503,204 S 3/2005 Nicolette et al.
6,860,819 B2 * 3/2005 Gilbert ..... 473/291
6,881,158 B2 4/2005 Yang
D504,925 S 5/2005 Schweigert et al.
D505,171 S 5/2005 Schweigert et al.
D507,614 S 7/2005 Schweigert et al.
6,921,344 B2 7/2005 Gilbert et al.
D508,099 S 8/2005 Schweigert et al.
6,929,563 B2 8/2005 Nishitani
6,935,967 B2 8/2005 Mahaffey et al.
D510,115 S 9/2005 Lang et al.
6,962,538 B2 11/2005 Roach et al.
D512,757 S * 12/2005 Cleveland et al. ..... D21/747
D513,423 S 1/2006 Best et al.
D514,183 S 1/2006 Schweigert et al.
6,984,180 B2 1/2006 Hasebe
6,991,559 B2 1/2006 Yabu
D516,152 S 2/2006 Madore
D517,625 S 3/2006 Sanchez et al.
D518,538 S 4/2006 Ines et al.
D519,179 S 4/2006 Roberts et al.
7,022,028 B2 * 4/2006 Nagai et al. ..... 473/291
D523,501 S 6/2006 Nicolette et al.
D525,330 S 7/2006 Imamoto
7,083,530 B2 8/2006 Wahl et al.
D528,617 S 9/2006 Imamoto
D530,759 S 10/2006 Nicolette et al.
D530,760 S 10/2006 Schweigert et al.
7,125,343 B2 10/2006 Imamoto
D531,688 S 11/2006 Frame et al.
D532,849 S 11/2006 Nicolette et al.
7,131,913 B2 11/2006 Iwata et al.
D534,228 S 12/2006 Nicolette et al.
7,147,571 B2 12/2006 Best et al.
D534,595 S 1/2007 Hasebe
D534,597 S 1/2007 Nicolette et al.
D536,759 S 2/2007 Schweigert et al.
D537,494 S 2/2007 Jertson et al.
D538,366 S 3/2007 Nicolette et al.

(56) References Cited

U.S. PATENT DOCUMENTS

| | | | | |
|---|---|---|---|---|
| 7,186,188 | B2 | 3/2007 | Gilbert et al. | |
| D539,862 | S | 4/2007 | Nunez et al. | |
| D539,864 | S | 4/2007 | Nicolette et al. | |
| D540,898 | S | 4/2007 | Solheim et al. | |
| D541,360 | S | 4/2007 | Schweigert et al. | |
| 7,207,900 | B2 | 4/2007 | Nicolette et al. | |
| D544,056 | S | 6/2007 | Nicolette et al. | |
| D547,410 | S | 7/2007 | Nicolette et al. | |
| 7,238,119 | B2 | 7/2007 | Roach et al. | |
| 7,244,188 | B2 | 7/2007 | Best | |
| D554,212 | S | 10/2007 | Nunez et al. | |
| D554,215 | S * | 10/2007 | Ruggiero et al. | D21/759 |
| D554,217 | S * | 10/2007 | Ruggiero et al. | D21/759 |
| D554,218 | S | 10/2007 | Ruggiero et al. | |
| 7,281,991 | B2 | 10/2007 | Gilbert et al. | |
| D557,502 | S | 12/2007 | Quartarone et al. | |
| D559,931 | S | 1/2008 | Roach et al. | |
| D561,855 | S | 2/2008 | Schweigert et al. | |
| D562,423 | S | 2/2008 | Foster et al. | |
| D562,925 | S | 2/2008 | Schweigert et al. | |
| D566,803 | S * | 4/2008 | Foster et al. | D21/747 |
| 7,371,190 | B2 | 5/2008 | Gilbert et al. | |
| D570,435 | S | 6/2008 | Sanchez et al. | |
| D570,935 | S | 6/2008 | Nicolette et al. | |
| D570,936 | S | 6/2008 | Schweigert et al. | |
| D571,422 | S | 6/2008 | Schweigert et al. | |
| D571,881 | S | 6/2008 | Nicolette et al. | |
| 7,390,270 | B2 | 6/2008 | Roberts et al. | |
| D572,326 | S | 7/2008 | Schweigert et al. | |
| D572,329 | S | 7/2008 | Nicolette et al. | |
| D573,219 | S | 7/2008 | Schweigert et al. | |
| 7,396,299 | B2 | 7/2008 | Nicolette et al. | |
| 7,399,238 | B2 | 7/2008 | Hocknell et al. | |
| D577,783 | S | 9/2008 | Schweigert et al. | |
| D578,590 | S | 10/2008 | Schweigert et al. | |
| D580,503 | S | 11/2008 | Roach et al. | |
| D581,000 | S | 11/2008 | Nicolette et al. | |
| 7,507,167 | B2 | 3/2009 | Roach et al. | |
| D595,797 | S | 7/2009 | Oldknow | |
| D596,256 | S | 7/2009 | Schweigert et al. | |
| D596,257 | S | 7/2009 | Jertson et al. | |
| D597,157 | S * | 7/2009 | Wallin et al. | D21/747 |
| D597,158 | S | 7/2009 | Schweigert et al. | |
| D598,060 | S | 8/2009 | Barez et al. | |
| D601,216 | S | 9/2009 | Jertson et al. | |
| D602,103 | S | 10/2009 | Jorgensen et al. | |
| D604,783 | S | 11/2009 | Nicolette et al. | |
| D607,073 | S | 12/2009 | Jertson et al. | |
| D621,893 | S | 8/2010 | Nicolette et al. | |
| D621,894 | S | 8/2010 | Schweigert | |
| D621,895 | S | 8/2010 | Schweigert et al. | |
| 7,789,771 | B2 * | 9/2010 | Park et al. | 473/332 |
| 7,789,772 | B2 | 9/2010 | Sukman | |
| 7,803,064 | B2 | 9/2010 | Roach et al. | |
| D627,410 | S | 11/2010 | Nicolette et al. | |
| 7,833,110 | B2 | 11/2010 | Nakamura | |
| D635,627 | S | 4/2011 | Nicolette et al. | |
| 7,935,000 | B2 * | 5/2011 | Stites | 473/291 |
| D642,642 | S | 8/2011 | Jertson et al. | |
| D643,491 | S | 8/2011 | Stokke et al. | |
| D643,492 | S | 8/2011 | Nicolette et al. | |
| D643,896 | S | 8/2011 | Jertson et al. | |
| 8,277,337 | B2 | 10/2012 | Shimazaki | |
| 8,403,774 | B2 * | 3/2013 | Stites | 473/350 |
| 2001/0044345 | A1 * | 11/2001 | Stites et al. | 473/334 |
| 2001/0055996 | A1 | 12/2001 | Iwata et al. | |
| 2002/0098910 | A1 | 7/2002 | Gilbert | |
| 2002/0128088 | A1 | 9/2002 | Yializis et al. | |
| 2002/0173376 | A1 | 11/2002 | Stites et al. | |
| 2003/0092499 | A1 * | 5/2003 | Gilbert | 473/291 |
| 2003/0092502 | A1 | 5/2003 | Pergande et al. | |
| 2003/0119602 | A1 | 6/2003 | Kennedy, III et al. | |
| 2003/0134687 | A1 | 7/2003 | Truesdale | |
| 2003/0139222 | A1 * | 7/2003 | Vadersen | 473/291 |
| 2003/0199331 | A1 * | 10/2003 | Stites, III | 473/290 |
| 2003/0228928 | A1 | 12/2003 | Yabu | |
| 2004/0147335 | A1 | 7/2004 | Iwata et al. | |
| 2005/0009632 | A1 | 1/2005 | Schweigert et al. | |
| 2005/0020377 | A1 | 1/2005 | Yang et al. | |
| 2005/0026716 | A1 | 2/2005 | Wahl et al. | |
| 2005/0064951 | A1 * | 3/2005 | Stites et al. | 473/291 |
| 2005/0096156 | A1 | 5/2005 | Chen | |
| 2005/0202899 | A1 | 9/2005 | Roach et al. | |
| 2005/0239572 | A1 | 10/2005 | Roach et al. | |
| 2005/0245325 | A1 | 11/2005 | Gilbert et al. | |
| 2005/0266932 | A1 | 12/2005 | Roach et al. | |
| 2006/0100033 | A1 | 5/2006 | Nelson et al. | |
| 2006/0166758 | A1 | 7/2006 | Roberts et al. | |
| 2006/0234811 | A1 | 10/2006 | Gilbert et al. | |
| 2006/0258480 | A1 | 11/2006 | Hou | |
| 2007/0117653 | A1 | 5/2007 | Yoneyama | |
| 2007/0155534 | A1 | 7/2007 | Tsai et al. | |
| 2007/0225084 | A1 | 9/2007 | Schweigert et al. | |
| 2007/0281796 | A1 | 12/2007 | Gilbert et al. | |
| 2008/0045353 | A1 | 2/2008 | Lo et al. | |
| 2008/0051220 | A1 | 2/2008 | Soracco et al. | |
| 2008/0058113 | A1 | 3/2008 | Nicolette et al. | |
| 2008/0242444 | A1 * | 10/2008 | Park et al. | 473/332 |
| 2008/0300065 | A1 | 12/2008 | Schweigert | |
| 2009/0029790 | A1 | 1/2009 | Nicolette et al. | |
| 2009/0029791 | A1 | 1/2009 | Solheim | |
| 2009/0149272 | A1 | 6/2009 | Roach et al. | |
| 2009/0149277 | A1 | 6/2009 | Deng et al. | |
| 2009/0275421 | A1 | 11/2009 | Gilbert et al. | |
| 2010/0160067 | A1 * | 6/2010 | Llewellyn et al. | 473/291 |
| 2010/0178999 | A1 | 7/2010 | Nicolette et al. | |
| 2010/0255923 | A1 | 10/2010 | Stites | |
| 2010/0267463 | A1 * | 10/2010 | Stites | 473/291 |
| 2010/0279794 | A1 | 11/2010 | Nicolette et al. | |
| 2010/0279795 | A1 | 11/2010 | Nicolette et al. | |
| 2010/0279796 | A1 | 11/2010 | Nicolette et al. | |
| 2011/0021285 | A1 | 1/2011 | Shimazaki | |
| 2011/0201444 | A1 | 8/2011 | Stokke et al. | |
| 2012/0289360 | A1 * | 11/2012 | Breier et al. | 473/335 |
| 2013/0109500 | A1 * | 5/2013 | Boyd et al. | 473/332 |
| 2013/0116064 | A1 * | 5/2013 | Park et al. | 473/332 |

FOREIGN PATENT DOCUMENTS

| | | |
|---|---|---|
| JP | 09285576 | 11/1997 |
| JP | 10201883 | 8/1998 |
| JP | 10277186 | 10/1998 |
| JP | 10277186 A | 10/1998 |
| JP | 200189545 | 7/2000 |

OTHER PUBLICATIONS

Ralph Maltby, Golf Club Design, Fitting, Alteration, & Repair, Jan. 1995, Ralph Maltby Enterprises, Inc., 4th Edition, p. 508.*

* cited by examiner

CLUB HEAD SETS WITH VARYING CHARACTERISTICS AND RELATED METHODS

CROSS-REFERENCE TO RELATED APPLICATIONS

This patent application claims priority to U.S. Provisional Patent Application No. 61/323,349, titled Club Head Sets With Varying Characteristics And Related Methods, filed on Apr. 12, 2010, and this patent application is a continuation-in-part application claiming priority to U.S. patent application Ser. No. 11/828,260, titled Golf Clubs and Methods of Manufacture, filed on Jul. 25, 2007 now abandoned.

The disclosures of the referenced applications are incorporated herein by reference.

TECHNICAL FIELD

This disclosure relates generally to sports equipment, and relates more particularly to club heads and related methods.

BACKGROUND

Golf clubs and specifically golf club heads of various designs have typically been developed to improve the functionality of a golfer's swing and resulting golf shot. In particular, many golfers are unable or lack consistency to hit "down" on a ball, that is, to regularly hit the ball squarely. Golf club design and, particularly, golf club head design may optimize a golf club head's weighting scheme, for example, center of gravity position and moments of inertia. Such designs may mitigate a golfer's inconsistency problems. Back weighting and/or an additional lower toe weighting may strategically position the center of gravity and may induce the golfer during his swing, to hit "down" on the ball, thus, hitting the ball squarely.

Figure 1:
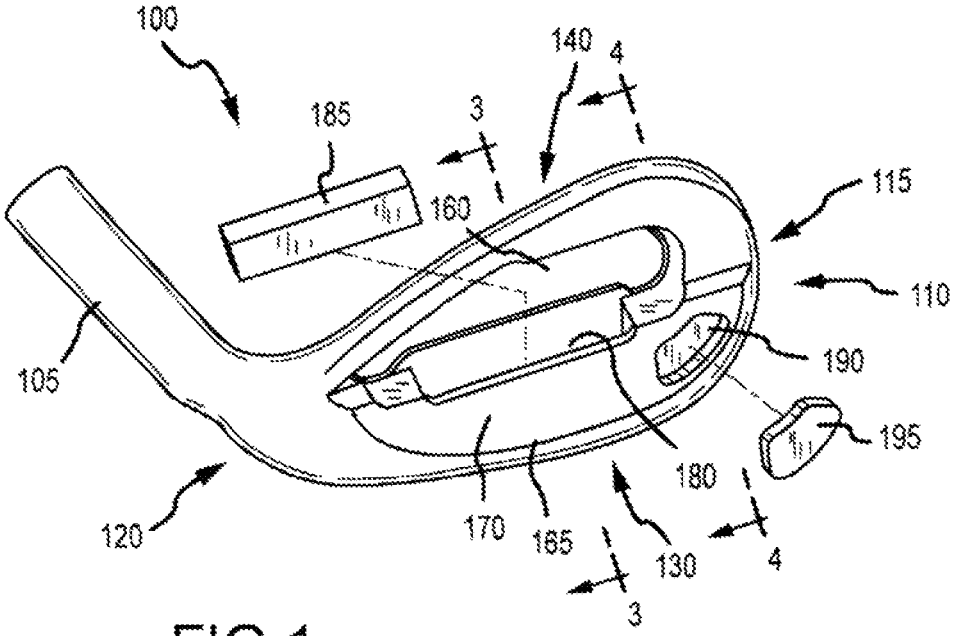
FIG. 1 illustrates an exploded view of an exemplary golf club head according to an embodiment of the golf clubs and methods of manufacture described herein.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf clubs and their methods of manufacture. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of golf clubs and methods of manufacture described herein are, for example, capable of operation in sequences other than those illustrated or otherwise described herein. Furthermore, the terms "contain," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of golf clubs and methods of manufacture described herein are, for example, capable of operation in other orientations than those illustrated or otherwise described herein. The term "coupled," as used herein, is defined as directly or indirectly connected in an electrical, physical, mechanical, or other manner.

DESCRIPTION

In one embodiment of the golf clubs and methods of manufacture described herein, a golf club head comprises a body having a toe region, a heel region opposite the toe region, a sole region, and a top region opposite the sole region. The golf club head further comprises a front face, a first back opposite the front face, a second back opposite the front face and extending farther from the front face than the first back. The second back extends from the heel region to the toe region, and extends from the sole region to about a midpoint between the sole region and the top region. The golf cub head further comprises a first cavity between the first back and the second back, and a second cavity integral with the second back at the toe region. This embodiment may further comprise a first weight that is inserted in the first cavity and a second weight inserted in the second cavity.

In another embodiment of golf clubs and methods of manufacture, a golf club head comprises a body comprising a front face, a heel region, a toe region opposite the heel region, and a sole. The sole extends from the heel region to the toe region, and the sole extends from the front face to a back sole edge. The golf club head further comprises a top opposite the sole, and a first back opposite the front face and substantially parallel to the front face. The first back extends from the heel region to the toe region, and extends from a midpoint between the sole and the top, to the top. The golf club head further comprises a second back opposite the front face extending from the back sole edge to about the midpoint. The golf club head further comprises a rectangular first cavity between the second back and the front face, and a second cavity integral with the second back at the toe region. This embodiment may further comprise a first weight that is inserted in the first cavity and a second weight inserted in the second cavity.

In another embodiment of golf clubs and methods of manufacture, a golf club comprises a golf club head described herein and coupled to a shaft. The golf club further comprises a hosel ratio of 0.75 wherein, the hosel ratio comprises a hosel distance to a front face distance. The hosel distance extends from a point at the heel region to a second end opposite the first end, and the front face distance comprises a distance measured along the front face from the point to a toe edge and substantially parallel to the sole. The golf club may further comprise a first weight to occupy the first cavity and a second weight to occupy the second cavity.

In an embodiment of golf clubs and methods of manufacture, a method for manufacturing a golf club head comprises providing a body having a toe region, a heel region opposite the toe region, a sole region, and a top region opposite the sole region. This embodiment further comprises a front face, a first back opposite the front face, a second back opposite the front face and extending farther from the front face than the first back. The second back extends from the heel region to the toe region, and extends from the sole region to about a midpoint between the sole region and the top region. The body is further provided to comprise a first cavity between the first back and the second back, and a second cavity integral with the second back at the toe region. This embodiment may further comprise providing a first weight that is inserted in the first cavity and providing a second weight inserted in the second cavity.

There can be examples in accordance with the present disclosure where a club head set can comprise two or more club heads, each comprising a loft angle, a front face, a back face opposite the front face, and one or more support bars protruded from the back face. The loft angle can be incrementally varied across the two or more club heads, and a characteristic of the one or more support bars is incrementally varied across the two or more club heads as the loft angle is incrementally varied across the two or more club heads.

There also can be examples in accordance with the present disclosure where a club head set can comprise first and second club heads. The first club head can comprise a first loft angle, a first front face, and a first back portion comprising a first heel region, a first toe region, a first back face opposite the first front face and extended between the first heel and toe regions, and one or more first support bars coupled to the first back face. The second club head can comprise a second loft angle, a second front face, and a second back portion comprising a second heel region, a second toe region, a second back face opposite the second front face and extended between the second head and toe regions, and one or more second support bars coupled to the second back face. In such examples, the first loft angle is greater than the second loft angle, and an attribute of the one or more first support bars is greater than an attribute of the one or more second support bars.

There also can be examples in accordance with the present disclosure where a method can comprise providing a club head set. Providing the club head set can comprise providing a first club head, the first club head comprising a first loft angle, a first front face, and a first back portion comprising, a first heel region, a first toe region, a first back face opposite the first front face and extended between the first heel and toe regions, and one or more first support bars coupled to the first back face, the one or more first support bars comprising a first support bar characteristic. Providing the club head set can also comprise providing a second club head, the second club head comprising a second loft angle, a second front face and a second back portion comprising a second heel region, a second toe region, a second back face opposite the second front face and extended between the second heel and toe regions, and one or more second support bars coupled to the second back face, the one or more second support bars comprising a second support bar characteristic. In such examples, providing the first club head comprises providing the first loft angle to be greater than the second loft angle, and providing the first support bar characteristic to be greater than the second support bar characteristic.

There also can be examples in accordance with the present disclosure where a club head set can comprise two or more club heads, each comprising a loft angle, a front face, and a backside comprising a back face opposite the front face, and a weight located only at a lower toe section of the backside. In such examples, the loft angle can be varied across the two or more club heads, a first characteristic of the weight can be varied across the two or more club heads, a second characteristic of the weight can be varied across the two or more club heads, and the first and second characteristics can be inversely varied relative to each other.

There also can be examples in accordance with the present disclosure where a club head set can comprise first and second club heads. The first club head can comprise a first loft angle, a first front face, and a first back portion that comprises a first heel region, a first toe region comprising a first lower toe section, and a first back face opposite the first front face and extended between the first heel and first toe regions. The second club head can comprise a second loft angle, a second front face, and a second back portion that comprises a second heel region, a second toe region comprising a second lower toe section, and a second back face opposite the second front face and extended between the second heel and second toe regions. The first club head can also comprise a first weight at the first lower toe section of the first toe region, and the second club head can also comprise a second weight at the second lower toe section of the second toe region. In such examples, the first loft angle can be greater than the second loft angle, the first and second weights can comprise substantially similar masses, the first and second weights each comprise first dimensions corresponding to each other, and the first and second weights each comprise second dimensions corresponding to each other. When the first dimension of the first weight is greater than the first dimension of the second weight, the second dimension of the second weight can be greater than the second dimension of the first weight. When the second dimension of the first weight is greater than the second dimension of the second weight, the first dimension of the second weight can be greater than the first dimension of the first weight.

There also can be examples in accordance with the present disclosure where a method can comprise providing a club head set. Providing the club head set can comprise providing a first club head of the club head set, and providing a second club head of the club head set. The first club head can comprise a first loft angle, a first front face, and a first back portion comprising a first back face opposite the first front face and extended between heel and toe regions of the first back portion and a first lower toe section comprising a first cavity. The second club head can comprise a second loft angle, a second front face, and a second back portion comprising a second back face opposite the second front face and extended between heel and toe regions of the second back portion, and a second lower toe section comprising a second cavity. Providing the first club head can comprise providing a first weight at the first cavity, and providing the first loft angle to be greater than the second loft angle. Providing the second club head can comprise providing a second weight at the second cavity. Providing the first weight can comprise providing a first length, a first width, and a first depth of the first weight. Providing the second weight can comprises providing a second length and a second width of the second weight such that at least one of the second length of the second weight is greater than the first length of the first weight, or the second width of the second weight is greater than the first width of the first weight. Providing the second weight can also comprise providing a second depth of the second weight such that the first depth of the first weight is greater than the second depth of the second weight.

There also can be examples in accordance with the present disclosure where a golf club head can comprise a front face and a back portion. The back portion can comprise a heel region, a toe region, a center region between the heel and toe regions, a back end extended between the heel and toe regions, and a cavity. The cavity can comprise a cavity heel zone, a cavity toe zone, a cavity center zone between the cavity heel and toe zones, a cavity inner section located towards the front face, and a cavity outer section located towards the back end. The cavity can be wider at the cavity center zone than at the cavity heel and toe zones.

There also can be examples in accordance with the present disclosure where a method can comprise providing an insert for a golf club head and/or providing a body of a club head. Providing the insert can comprise providing insert heel and toe zones, and providing an insert center zone between the insert heel and toe zones that is thicker than the insert heel and toe zones. Providing the body can comprise providing a back face and a back end at a back portion of the body, and providing a cavity between the back face and the back end. The cavity can comprise a cavity inner section adjacent to the back face, a cavity outer section opposite the back end, cavity heel and toe zones, and a cavity center zone between the cavity heel and toe zones that is thicker than the cavity heel and toe zones. The insert can be provided to be at least partially housed in the cavity.

There also can be examples in accordance with the present disclosure where a golf club head can comprise a back portion of a body of the club head, and an insert. The back portion can comprise a heel region, a toe region, a center region between the heel and toe regions, a back surface opposite the front face and extended between the heel and toe regions, a back wall extended between the heel and toe regions, and a cavity located between the back surface and the back wall. The cavity can comprise a cavity heel zone, a cavity toe zone, a cavity center zone between the cavity heel and toe zones, a cavity inner wall comprising a portion of the back surface, and a cavity outer wall located opposite the back wall. The insert can comprise an insert heel zone, an insert toe zone, an insert center zone between the insert heel and toe zones, an insert inner wall complementary to the cavity inner wall, and an insert outer wall complementary to the cavity outer wall. The golf club head can comprise a moment of inertia about the center region. The insert can be configured to be at least partially housed in the cavity. The cavity can be wider, from the cavity inner wall to the cavity outer wall, at the cavity center zone than at the cavity heel and toe zones. The insert can be wider, from the insert inner wall to the insert outer wall, at the insert center zone than at the insert heel and toe zones. A distribution of mass of the cavity inner wall can be concentrated at the cavity center zone. A distribution of mass of the insert can be shifted away from the insert heel and toe zones and towards the insert center zone. A density of a body of the golf club head can be greater than a density of the insert. A first portion of the moment of inertia contributed by the body of the club head at the cavity heel and toe zones can be greater than a second portion of the moment of inertia contributed by the insert at the insert heel and toe zones. The insert heel and toe zones can be obtusely angled relative to each other about the insert center zone and along the insert inner wall. The cavity inner wall can be obtusely angled complementarily to the insert inner wall. The insert can comprise a grip portion to aid during removal of the insert from the cavity, where the grip portion can be configured to remain external to the cavity when the insert is housed in the cavity.

Other examples and embodiments are further disclosed herein. Such examples and embodiments may be found in the figures, in the claims, and/or in the description of the present application.

Figure 2:
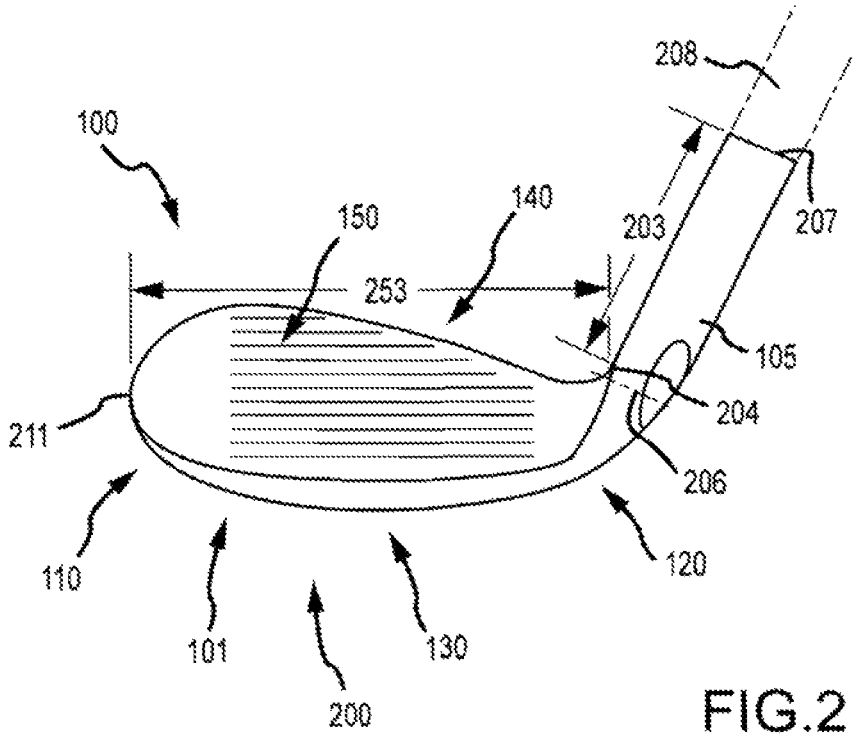
FIG. 2 illustrates a front view of the exemplary golf club head of FIG. 1.

Turning now to the figures, FIG. 1 illustrates a rear, exploded perspective view of an exemplary golf club head 100 according to an embodiment of golf clubs and methods of manufacture, and FIG. 2 illustrates a front view of the golf club head 100. In one embodiment of the golf clubs and methods of manufacture described herein, the golf club head 100 comprises a body 101 having a toe region 110, a heel region 120 opposite the toe region 110, a hosel 105 at the heel region 120, a sole region 130, and a top region 140 opposite the sole region 130. The sole region 130 may extend from the heel region 120 to the toe region 110, and the sole region 130 may extend from a front face 250 (FIG. 2) to a back sole edge 165. In a different embodiment, the golf club head 100 may have a bore (not shown), instead of the hosel 105, at the heel region 120.

Figure 5:
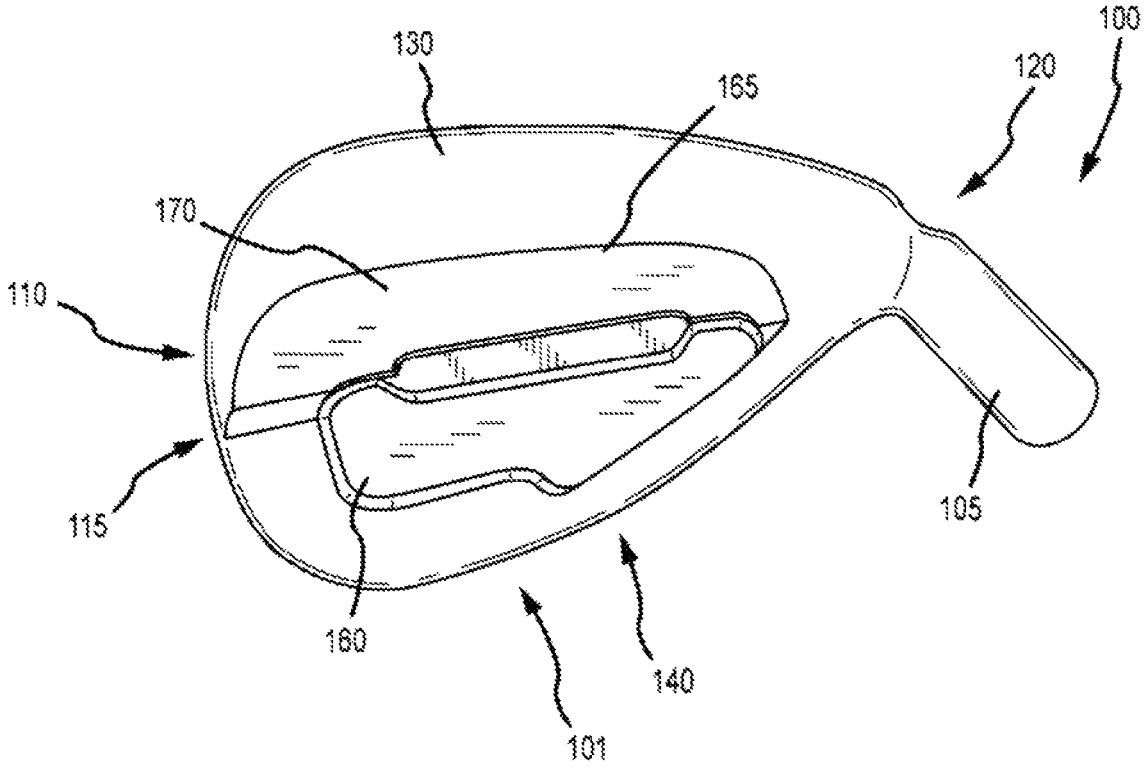
FIG. 5 illustrates a perspective view of the exemplary golf club head of FIG. 1.

The golf club head 100 further comprises a first back 160 (FIG. 1) opposite the front face 250 (FIG. 2), a second back 170 (FIG. 1) opposite the front face 250 (FIG. 2) and extending farther from the front face 250 (FIG. 2) than the first back 160 (FIG. 1), as explained in more detail hereinafter. The first back 160 may be substantially parallel to the front face 250 (FIG. 2) and the first back 160 may extend from the heel region 120 to the toe region 110. The first back 160 may also extend from the sole 130 to a midpoint 115 (FIG. 1) between the sole region 130 and the top region 140, and may further extend from the midpoint 115 to the top region 140. The second back 170 (FIG. 1) may extend from the heel region 120 to the toe region 110, and may extend from the sole region 130 to about the midpoint 115 (FIG. 1) between the sole region 130 and the top region 140, as can be seen in FIGS. 1 and 5. In a different embodiment, back face 170 (FIG. 1) may extend from the sole region 130 beyond the midpoint 115, or the back face 170 may extend from the sole region 130 below the midpoint 115.

Figure 3:
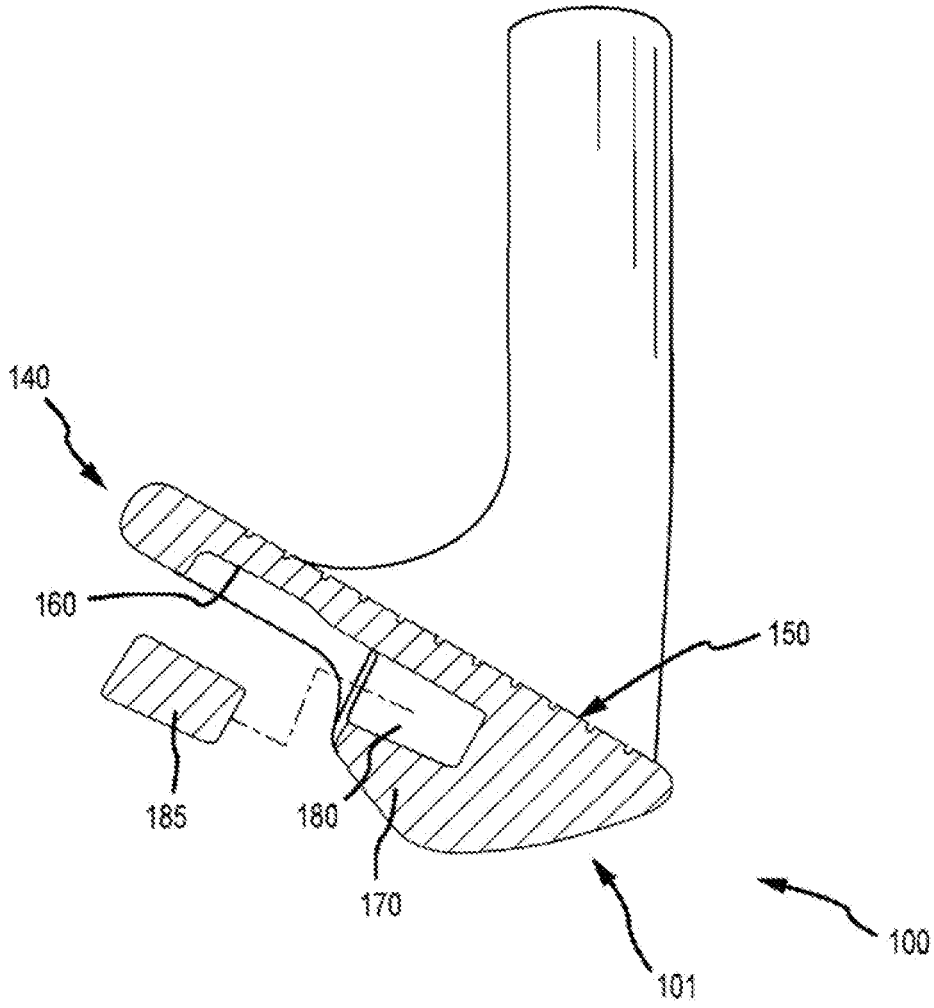
FIG. 3 illustrates an exploded, cross-sectional view of the exemplary golf club head, taken from a section line 3-3 in FIG. 1.

As illustrated in FIGS. 1 and 3, the golf club head 100 further comprises a first cavity 180 between the first back 160 and the second back 170. As illustrated in FIG. 3, the first cavity 180 separates the first back 160 from the second back 170, and vice versa. According to the various embodiments described herein, the golf clubs and methods of manufacture comprise the first cavity 180 to have a rectangular shape, but other configurations are contemplated. For example, the first cavity 180 may comprise an irregular shape, or a different regular shape, for example, triangular, circular, octagonal, hexagonal, and the like. In another example, the first cavity 180 may comprise a symmetrical shape or an asymmetrical shape. Moreover, the first cavity 180 may comprise various dimensions.

Figure 4:
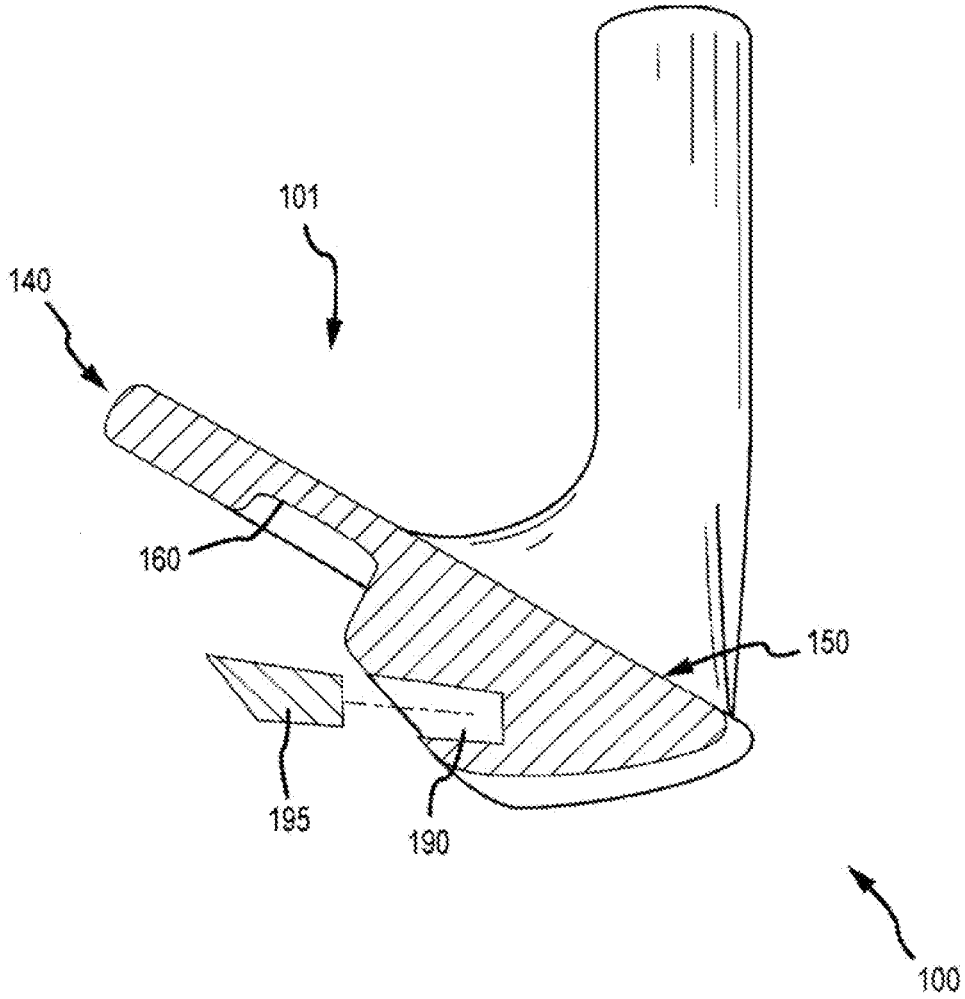
FIG. 4 illustrates an exploded, cross-sectional view of the exemplary golf club head, taken from a section line 4-4 in FIG. 1.

As illustrated in FIGS. 1 and 4, the golf club head 100 also comprises a second cavity 190 integral with the second back 170 at the lower toe region 110. Similar to the first cavity 180, the second cavity 190 may also comprise various shape and dimensional configurations. The shape and dimensional of the first cavity 180 and the second cavity 190 may be determined by the variables that optimize the utility of the golf club head 100, and to adjust the moments of inertia, the center of gravity, and the like. Also, the golf clubs and methods of manufacture described herein, may further comprise cavities that vary in volume, and the volume may depend upon the desired design of the golf club head. Although the above examples may describe two cavities (e.g., the first and second cavities 180 and 190), the golf clubs and methods of manufacture described herein may include additional cavities.

This embodiment of golf club head 100 may further comprises a first weight 185 that is inserted in the first cavity 180 and a second weight 195 that is inserted in the second cavity 190. According to the various embodiments described herein, first weight 185 and second weight 195 may comprise various shapes and dimensional configurations. For example, the first weight 185 and the second weight 195 may comprise shapes and dimensions that are complimentary to the respective cavities into which they are inserted (e.g., the first and second cavities 180 and 190, respectively). In another example, the first weight 185 and the second weight 195 may comprise shapes that only partially occupy the cavities into which they are inserted, or the first weight 185 and the second weight 195 may comprise shapes that overfill the first and second cavities 180 and 190, respectively. The first weight 185 and the second weight 195 can comprise various materials. In one embodiment, the first weight 185 comprises a metal matrix material. In another embodiment, the first weight 185 comprises a polymer, and may be either a thermoset or thermoplastic polymer. First weight 185 may comprise a specific gravity of approximately 1 g/cm$^3$ (grams per cubed centimeter) to approximately 9 g/cm3 in some examples. The second weight 195 may comprise a metal, and may be either a single elemental metal such as iron, or a metal alloy, such as tungsten or titanium alloy. In this embodiment, the first weight 185 comprises a metal matrix material because it generally provides the ability to adjust the back weighting more so than the lightest, or least dense metal or metal alloy, and the second weight 195 comprises a metal because an outer toe weight may be beneficial to induce a golfer to swing "downwardly" and "outwardly." In another embodiment, the first weight 185 and the second weight 195 may comprise of the same material, such as a polymer, a composite, a metal, or a metal alloy. The body 101 can comprise standard golf club head materials such as iron, iron alloys, titanium alloys, and the like, and the first weight 185 and the second weight 195 can comprise the same or different materials as the body 101. As with the shape determination for the first and second cavities, the material determination may be similarly dependant upon the variables that maximize the utility of the golf club head, and other material configurations other than those specifically described are contemplated.

In another embodiment of golf clubs and methods of manufacture, and with reference to FIG. 2 a golf club 200 comprises the golf club head 100 coupled to a shaft 208. In this embodiment, the golf club 200 may further comprise a hosel ratio of 0.75. The hosel ratio comprises a hosel distance 203 to a front face distance 253. The hosel distance 203 measures from a first end 206 at about the heel region 120 to a second end 207 opposite the first end 206. The first end 206 is located at a point 204 where a linear portion of the hosel 105 begins to curve into the front face 250. The front face distance 253 comprises the distance measured along the front face 250 from the point 204 to a toe edge 211 and substantially parallel to the sole 130. The golf club 200 may further comprise, for example as shown in FIG. 1, the first weight 185 to occupy the first cavity 180 and the second weight 195 to occupy the second cavity 190.

The golf club 200, as described herein with the cavities and inserted weights of the golf club head 100, provides for an exemplary golf club that assists a golfer to improve his or her golf swing by allowing for customization of the back weight and toe weight in the club head 100. Furthermore, among the various embodiments described herein, the golf clubs and their methods of manufacture may be for irons, drivers, fairway woods, hybrids, putter, and or other suitable types of clubs.

In an embodiment of golf clubs and methods of manufacture, a method 600 for manufacturing a golf club head comprises providing a golf club head (a block 610). The golf club head of the block 610 may be similar to the golf club head 100 shown in FIGS. 1-5. Method 600 further comprises determining a first weight (a block 620), securing the first weight in a first cavity (a block 630), determining a second weight (a block 640), and securing the second weight in a second cavity (a block 650). As an example, the first weight of the block 620 may be similar to the first weight 185 of FIG. 1, and the second weight of the block 640 may be similar to the second weight 195 of FIG. 1.

Furthermore, the determining step in the block 620 may include having a professional golf technician analyze a golfer's swing. Depending on the swing analyzed by the professional golf technician, a lighter or heavier weight may be determined. Similarly, the determining step in the block 640 may likewise include determining whether to use a lighter or heavier weight based upon analysis of a golfers swing by a professional golf technician. In addition or alternatively, software, firmware, and/or hardware may be used to determine the first weight (e.g., monitor, measure, and/or analyze various parameters associated with an individual's golf swing).

In an embodiment of golf clubs and methods of manufacture, a method 700 for manufacturing a golf club, comprises providing a golf club head (the block 610), determining a first weight (the block 620), securing the first weight in a first cavity (the block 630), determining a second weight (the block 640), securing the second weight in a second cavity (the block 650), and coupling the body to a golf club shaft (a block 760). As an example, the shaft of the block 760 may be similar to the shaft 208 of FIG. 2. Also, the coupling step of the block 760 can include taping, adhering, welding, swaging, or other suitable techniques.

According to the method embodiments described herein, the method for securing the first and/or second weight(s) comprises any process to secure the weights in their respective cavities. For example, if either of the weights comprises a polymer material, then the weights may be glued and/or secured by an adhesive. If, for example, either of the weights is made of metal, then the weights may be similarly glued or secured by an adhesive, and additionally may be secured by any other known method for securing a metal within a cavity, such as welding, swaging, and the like.

Figure 6:
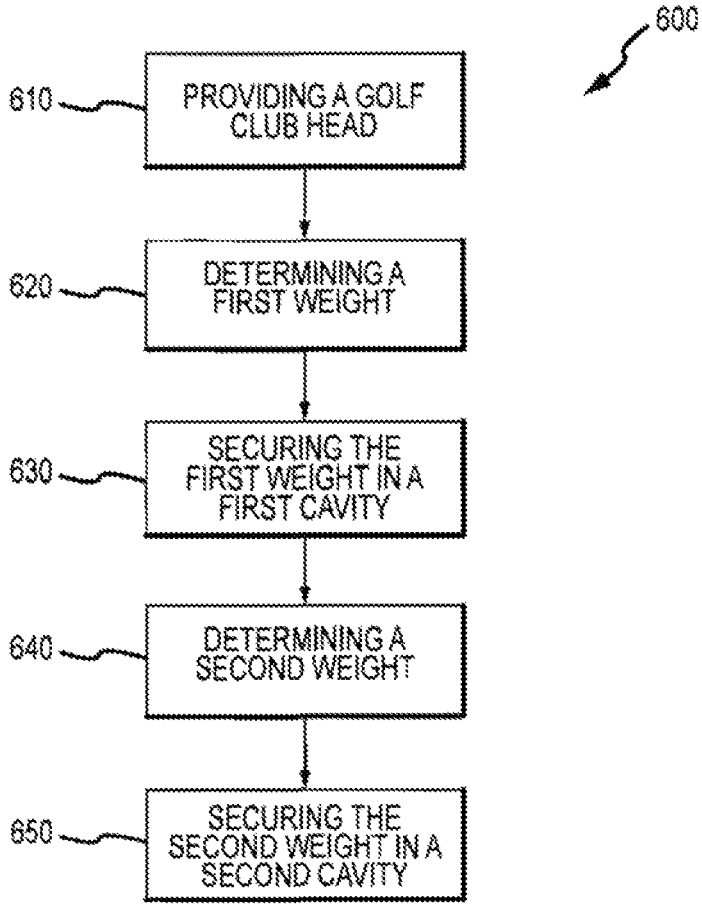
FIG. 6 depicts a flow diagram representation of one manner in which a golf club head may be manufactured.
Figure 7:
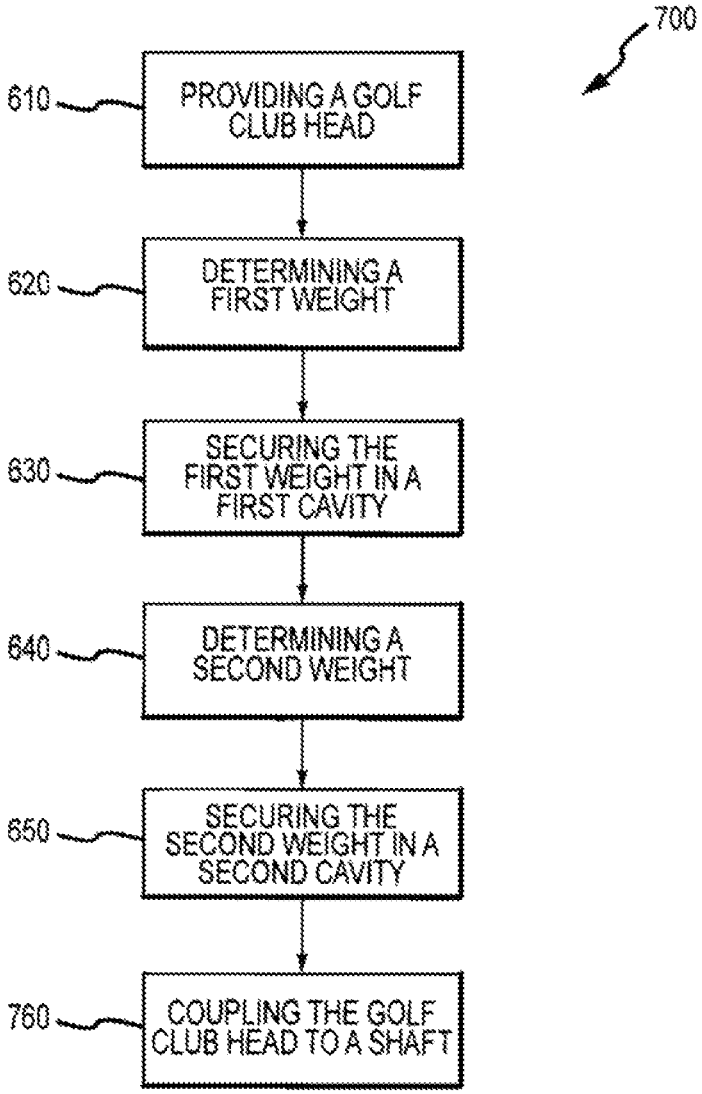
FIG. 7 depicts a flow diagram representation of one manner in which a golf club may be manufactured.

Although a particular order of actions is illustrated in FIGS. 6 and 7, these actions may be performed in other temporal sequences. For example, the actions depicted in FIGS. 6 and 7 may be performed sequentially, concurrently, or simultaneously. Also, the blocks 640 and 650 can be performed before the blocks 620 and 630, and the blocks 620 and 640 may be performed before the blocks 630 and 650.

The providing steps in the described methods of FIGS. 6 and 7 may include designing and/or manufacturing a golf club head. As an example, body 100 in FIG. 5 may be manufactured using a metal casting process. Furthermore, the described methods may be used to manufacture the other aspects of body 100 described with reference to FIGS. 1-5.

Figure 8:
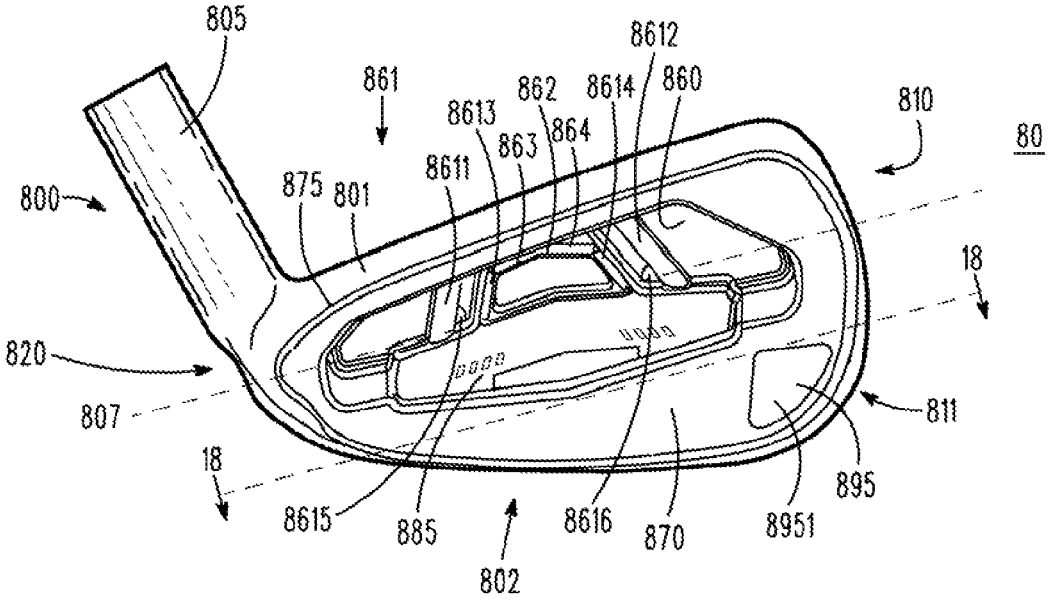
FIG. 8 presents a rear view of a club head of a club head set with varying characteristics according to an embodiment of the golf clubs and methods of manufacture described herein.
Figure 9:
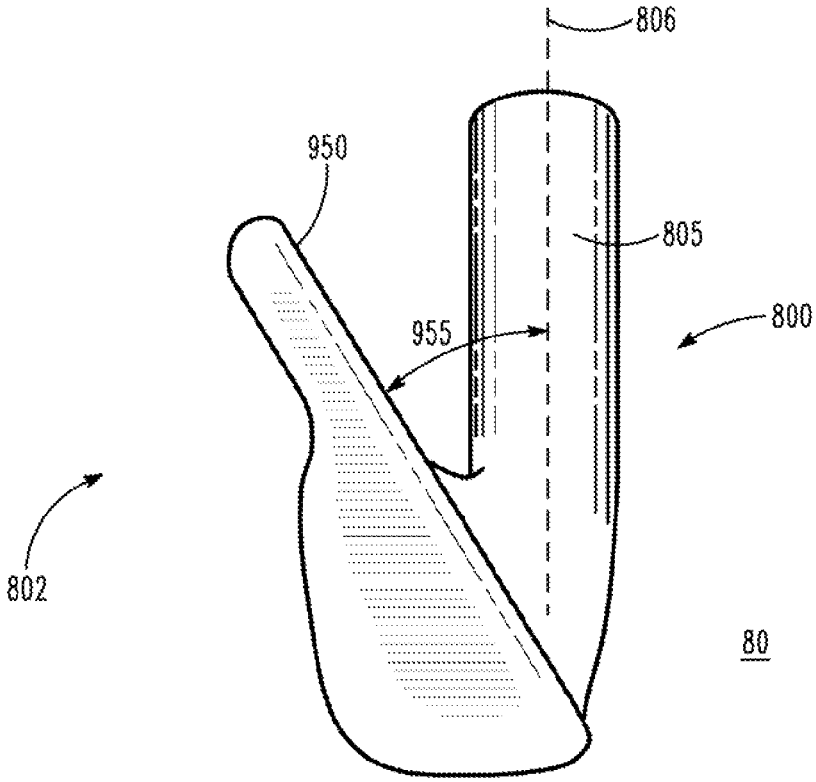
FIG. 9 presents a toe side view of the club head of FIG. 8.
Figure 10:
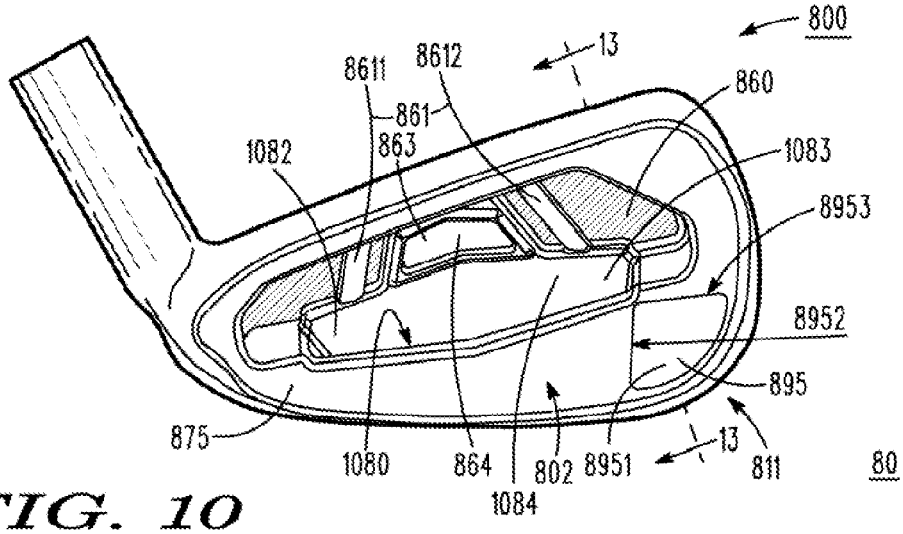
FIG. 10 illustrates a rear view of a body of the club head of FIG. 8, where the club head is in a disassembled state.

Continuing with the figures, FIG. 8 presents a rear view of club head 800 of club head set 80 according to an embodiment of the golf clubs and methods of manufacture described herein. FIG. 9 presents a toe side view of club head 800. FIG. 10 illustrates a rear view of body 801 of club head 800, where club head 800 is in a disassembled state. Club head 800 is similar to club head 100 (FIGS. 1-5), and comprises loft angle 955 (FIG. 9) between front face 950 (FIG. 9) and shaft bore axis 806. In the present example of FIG. 9, shaft bore axis 806 is defined by a bore of hosel 805, but there can be other hosel-less examples where shaft bore axis 806 could be defined by a shaft bore at a heel of a club head body. In the present example of FIG. 8, club head 800 also comprises back portion 802 comprising back face 860 opposite front face 950 (FIG. 9) and extended between toe region 810 and heel region 820 of back portion 802. In some embodiments, back portion 802 can also be referred to as a back side of club head 800. Club head 800 also comprises inserts 885 and 895 in the present embodiment. Insert 885 can be similar to weight 185 (FIGS. 1, 3), and can be inserted at back portion 802 into a cavity 1080 (FIG. 10) similar to cavity 180 of club head 100 (FIGS. 1, 3, 5). Lower toe insert 895 can be similar to weight 195 of club head 100 (FIGS. 1, 4). Club head 800 comprises part of club head set 80 of two or more golf clubs, as will be further discussed below.

Club head 800 also comprises insert 862 located at insert base 863 at a center of back face 860 in the present embodiment. As shown in FIG. 8, insert 862 comprises a logo or other identifying characteristic related to club head 800. There can be embodiments where insert 862 can comprise materials such as those described for weight 185 and/or weight 195 in FIGS. 1, 3, and 4, such as to have an effect on sound, vibration, frequency, and/or mass distribution of club head 800.

Club head 800 differs from club head 100 (FIGS. 1-5) by comprising support bars 861 coupled to back face 860 astride of, and equidistant from, center region 864. Support bars 861 comprise support bars 8611 at heel region 820, and support bar 8612 at toe region 810, both protruding from back face 860. There can be other examples, however, with a different number and/or different arrangement of support bars. For example, additional support bars may be positioned between support bar 8611 and the heel end of heel region 820. Similarly, additional support bars may be positioned between support bar 8612 and the toe end of toe region 810. In some examples, insert base 863 may be considered as also comprising one or more support bars. For example, base ends 8613 and 8614 of insert base 863 can also be considered in some examples as support bars protruding from back face 860. In addition, there can be examples where insert base 863 is protruding from back face 860, such that insert base 863 may itself be considered a support bar.

In the present embodiment, support bars 8611 and 8612 comprise substantially the same support bar width. In the same or other embodiments, the support bar width can be of approximately 0.03 inches (0.75 millimeters) to approximately 0.5 inches (12.7) millimeters). Although the support bar width is constant for both support bars 8611 and 8612 in the example of FIG. 8, there can be other examples where the support bar width tapers or otherwise varies along a length of a support bar similar to support bar 8611 and/or 8612. In addition, although the support bar thickness also is constant for support bars 861 in the present example, there also can be examples where the support bar thickness can taper or otherwise vary, as measured from back face 860, along a length of a support bar similar to support bar 8611 and/or 8612.

Support bars 861 are integral with back face 860 in the present embodiment by comprising part of the same piece of material. For example, support bars 861 can be cast, forged, or machined along with back face 860. There can be other embodiments where support bars may not be integral with their respective back faces, but are securely attached thereto. In such examples, the support bars can be welded, brazed, epoxied, or otherwise adhered to the back faces.

In the present embodiment, support bar 8611 comprises angle 8615 facing center region 864 and measured from horizontal axis 807. Similarly, support bar 8612 also comprises angle 8616 facing center region 864 and measured from horizontal axis 807. Horizontal axis 807 is an axis bisecting club 800 into an upper half and a lower half. There can be embodiments where angles 8615 and/or 8616 comprise acute angles of approximately 30 degrees to approximately 90 degrees from horizontal axis 807. In the same or other embodiments, support bars 8611 and 8612 are angled for convergence towards center region 864. There can also be embodiments where angles 8615 and/or 8616 can be obtuse and/or of approximately 90 degrees to approximately 150 degrees from horizontal axis 807. Angles 8615 and 8616 both comprise approximately 68 degrees in the example of FIG. 8, but there can be other embodiments where angles 8615 and 8616 are not equal to each other, and/or where at least one of angles 8615 and/or 8616 are not acute relative to center region 864. Angles 8615 and/or 8616 may remain constant across the different club heads of club head set 80, or they may vary within the same club head set from club head to club head.

Figure 18:
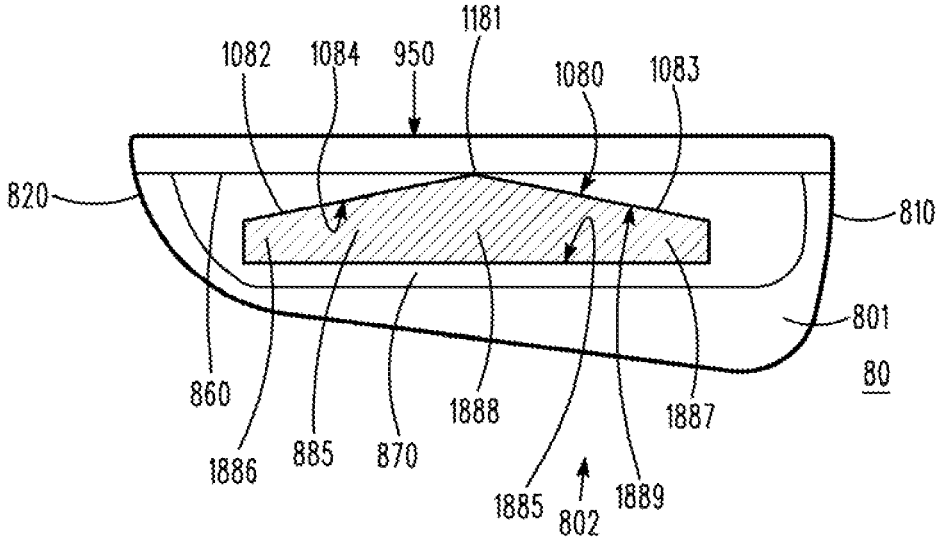
FIG. 18 illustrates a cross-sectional view of the club head of FIG. 8 along line 18-18 from FIG. 8.

FIG. 10 illustrates a rear view of body 801 of club head 800 in a disassembled state. Skipping ahead in the figures, FIG. 18 illustrates a cross-sectional view of club head 800 along line 18-18 from FIG. 8. Note that, for simplicity, details about lower toe insert 895 have been left out of FIG. 18, but insert 885 is shown as inserted into cavity 1080. As seen in FIGS. 8, 10, and 18, back portion 802 of club head 800 comprises back end 870 extended between heel region 820 and toe region 810, where back end 870 can be similar to second back 170 of club head 100 (FIGS. 1, 3-5). In some examples, back end 870 can be referred to as a back wall. Cavity 1080 is also located at back portion 802, between back face 860 and back end 870, and comprises cavity heel zone 1082, cavity toe zone 1083, cavity center zone 1181, cavity inner section 1084 located towards front face 950, and cavity outer section 1885 located towards back end 870. In the present example, cavity inner section 1084 is located opposite back face 860, and cavity outer section 1885 is located opposite back end 870. In the present embodiment, as seen in FIG. 18, cavity 1080 is wider at cavity center zone 1181 than at either of cavity heel zone 1082 or cavity toe zone 1083. For example, cavity inner section 1084 is thinner, relative to front face 950, at cavity center zone 1181 than at either of cavity heel zone 1082 or cavity toe zone 1083. In some examples, cavity inner section 1084 can be referred to as a cavity inner wall, and/or cavity outer section 1885 can be referred to as a cavity outer wall.

In the present example, a distance between front face 950 and an exposed surface of cavity inner section 1084 is greater at cavity heel zone 1082 and at cavity toe zone 1083 than at cavity center zone 1181. There can also be embodiments where a distance between back end 870 and an exposed surface of cavity outer section 1885 can be greater at cavity heel zone 1082 and at cavity toe zone 1083 than at cavity center zone 1181.

Insert 885 comprises insert heel zone 1886, insert toe zone 1887, and insert center zone 1888 in the present embodiment, and is shaped complementarily to cavity 1080 such that insert center zone 1888 is thicker than either of insert heel zone 1886 or insert toe zone 1887. In the example of FIG. 18, insert heel and toe zones 1886 and 1887 are obtusely angled relative to each other along insert inner wall 1889 and about insert center zone 1888. Similarly, cavity inner section 1084 is obtusely angled complementarily to insert inner wall 1889. In the present example, cavity 1080 is configured such that insert 885 is insertable in a top-to-sole direction with respect to club head 800. There can also be examples where insert 885 can be interchangeable with other inserts of similar shape.

In some examples, a material of body 801 of club head 800 can comprise a specific gravity of at least approximately 5.0 $g/cm^3$, and/or a material of insert 885 can comprise a specific gravity of at least approximately 1.2 $g/cm^3$. In the same or other examples, a mass of insert 885 can be of approximately 10 grams.

The dimension relationships described above for and between cavity 1080 and insert 885 can be beneficial, for example, to permit adjustments in the distribution of mass for club head 800. In the present embodiment, where a material of insert 885 is less dense than a material of body 801 of club head 800, the greater thickness of cavity inner section 1084 at cavity heel zone 1082 and at cavity toe zone 1083, relative to cavity center zone 1181, and the greater thickness of insert center zone 1888 relative to insert heel zone 1886 and insert toe zone 1887, can permit a redistribution of mass away from a center of club head 800 and towards heel and toe regions 820 and 810. As an example, a distribution of mass of cavity inner section 1084 is shifted towards heel region 820 and towards toe region 810 and away from cavity center zone 1181. Also, a distribution of mass of insert 885 is concentrated at insert center zone 1888 and diminishes towards insert heel zone 1886 and towards insert toe zone 1887.

Such distributions of mass can augment the moment of inertia about a center region of club head 800, and improve gameplay by reducing club head twisting during off-center impacts. For example, due to the shapes and configurations described above, a portion of the moment of inertia contributed by cavity inner section 1084 at cavity heel zone 1082 and at cavity toe zone 1083 is greater than a portion of the moment of inertia contributed by insert 885 at insert heel zone 1886 and at insert toe zone 1887. Other shape and/or density relationships between insert 885 and cavity 1080 may be used to achieve different desired distributions of mass or moments of inertia in other embodiments.

As shown in FIGS. 8 and 18, insert 885 is partially housed in cavity 1080, such that a grip portion of insert 885 protrudes outside cavity 1080 to allow or facilitate, for example, insertion or removal of insert 885 to or from cavity 1080. In other embodiments, however, insert 885 need not protrude from cavity 1080. Support bars 861 also extend from back face 860 to cavity inner section 1084 in the present embodiment, and cavity inner section 1084 is at least as thick as support bars 861, relative to back face 860, so as to prevent support bars 861 from interfering with the insertion or removal of insert 885 into or out of cavity 1080.

Figure 11:
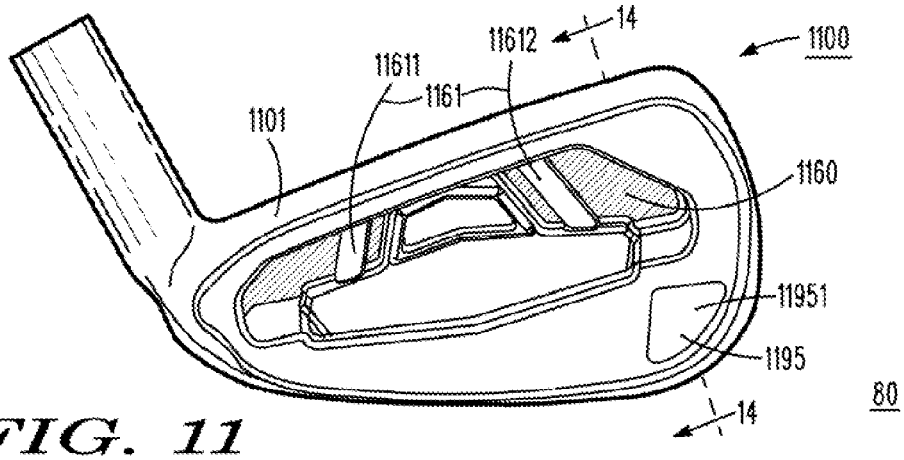
FIG. 11 illustrates a rear view of a body of another club head of the club head set of the club head of FIG. 8, where the club head is in a disassembled state.
Figure 12:
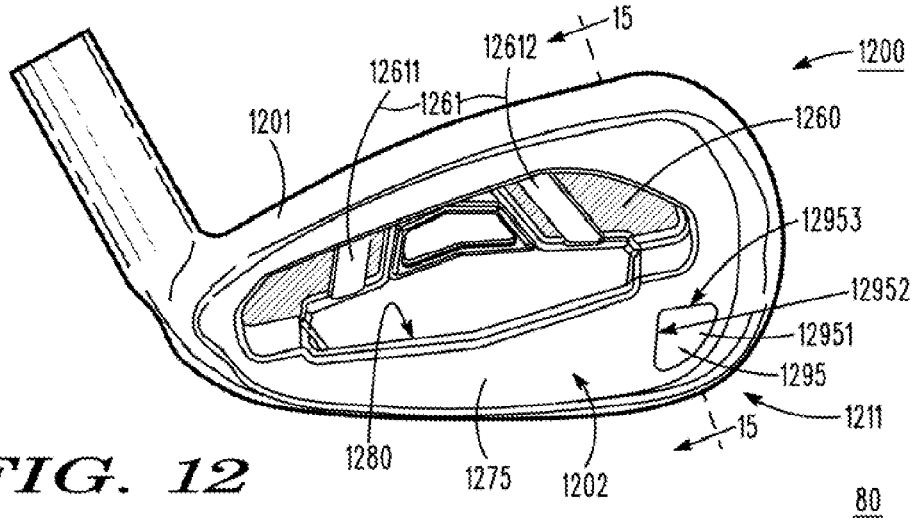
FIG. 12 illustrates a rear view of a body of yet another club head of the club head set of the club head of FIG. 8, where the club head is in a disassembled state.
Figure 15:
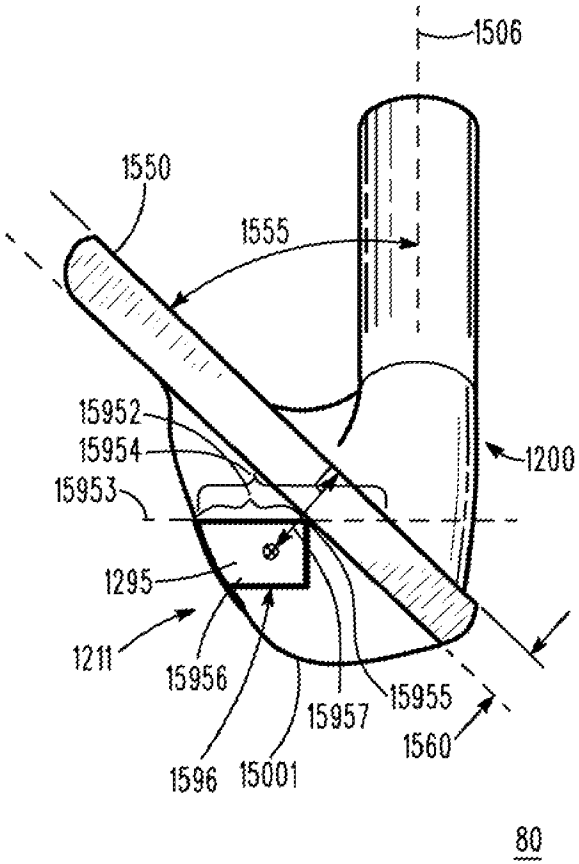
FIG. 15 illustrates a cross-sectional view of the club head of FIG. 12 along a line 15-15 of FIG. 12.
Figure 14:
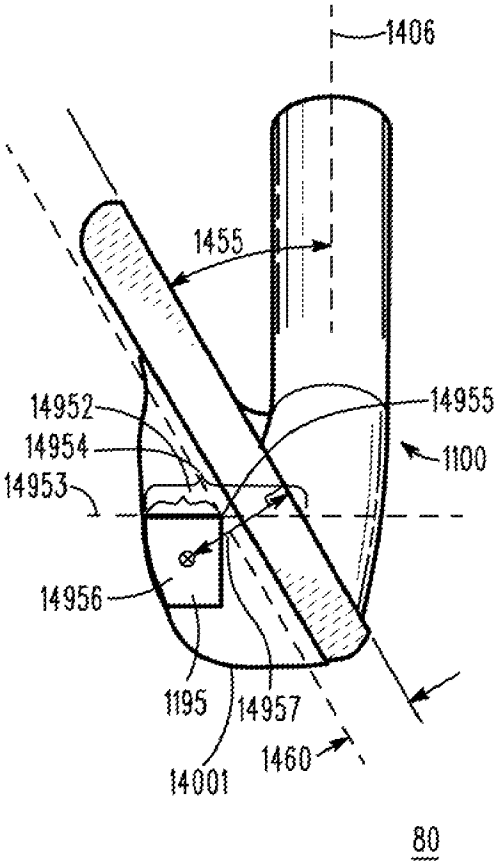
FIG. 14 illustrates a cross-sectional view of the club head of FIG. 11 along a line 14-14 of FIG. 11.
Figure 13:
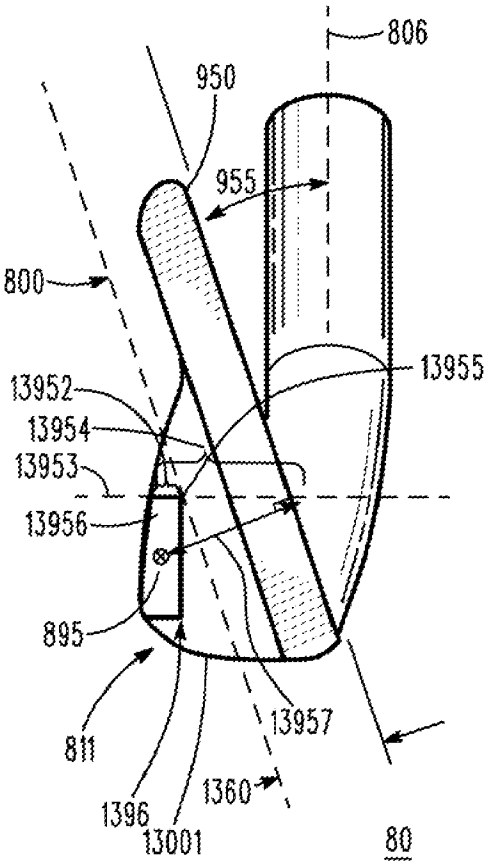
FIG. 13 illustrates a cross-sectional view of the club head of FIGS. 8 and 10 along a line 13-13 of FIG. 10.

Backtracking through the figures, FIGS. 10-15 illustrate several views of exemplary club heads of club head set 80. FIG. 10 illustrates a rear view of body 801 of club head 800, where club head 800 is in a disassembled state. FIG. 11 illustrates a rear view of body 1101 of club head 1100 of club head set 80, where club head 1100 is in a disassembled state. FIG. 12 illustrates a rear view of body 1201 of club head 1200 of club head set 80, where club head 1200 is in a disassembled state. FIG. 13 illustrates a cross-sectional view of club head 800 along a line 13-13 of FIG. 10. FIG. 14 illustrates a cross-sectional view of club head 1100 along a line 14-14 of FIG. 11. FIG. 15 illustrates a cross-sectional view of club head 1200 along a line 15-15 of FIG. 12. Club heads 800, 1100, and 1200 can be similar to each other, as detailed below.

In the present example, club heads 800, 1100, and 1200 form part of club head set 80 of related golf clubs, where club head set 80 can comprise two or more club heads. Only club heads 800, 1100, and 1200 of club head set 80 are shown in FIGS. 10-12 for simplicity, but club head set 80 can comprise more than three club heads. There also can be other embodiments where club head set 80 can comprise only two club heads. Each club head of club head set 80 comprises one or more support bars protruded from their respective back faces. For example, as seen in FIGS. 8 and 10, club head 800 comprises support bars 861, including support bars 8611 and 8612 protruded from back face 860, as detailed above. As seen in FIG. 11, club head 1100 comprises support bars 1161, namely, support bars 11611 and 11612, protruded from back face 1160. In addition, as seen in FIG. 12, club head 1200 comprises support bars 1261, namely, support bars 12611 and 12612, protruded from back face 1260.

In the present example, the loft angles of the club heads of club head set 80 are incrementally varied across the two or more club heads. For instance, in the present example of club head set 80, club head 800 comprises a 2-iron club head with loft angle 955 (FIG. 9) of approximately 18.5 degrees between front face 950 and shaft bore axis 806, (FIG. 13); club head 1100 comprises a 6-iron club head with loft angle 1455 of approximately 30.5 degrees between front face 1450 and shaft bore axis 1406 (FIG. 14); and club head 1200 comprises a wedge-iron club head with loft angle 1555 of approximately 47 degrees between front face 1550 and shaft bore axis 1506 (FIG. 15). As a result, the loft angle 1555 of club head 1200 is greater than loft angle 1455 of club head 1100, which, in turn, is greater than loft angle 955 of club head 800.

Also in the present example, a characteristic of the one or more support bars is incrementally varied across the two or more club heads according to the loft angle. For instance, loft angle 1555 is greater than loft angle 1455 as discussed above, and accordingly, an attribute of support bars 1261 of golf club 1200 (FIG. 12) is greater than an attribute of support bars 1161 of golf club 1100 (FIG. 11). In the present example, the attribute of the support bars that undergoes variation is the support bar width, such that support bars 1261 (FIG. 12) are wider than support bars 1161 (FIG. 11), and support bars 1161 (FIG. 11) are wider than support bars 861 (FIG. 10).

Figure 16:
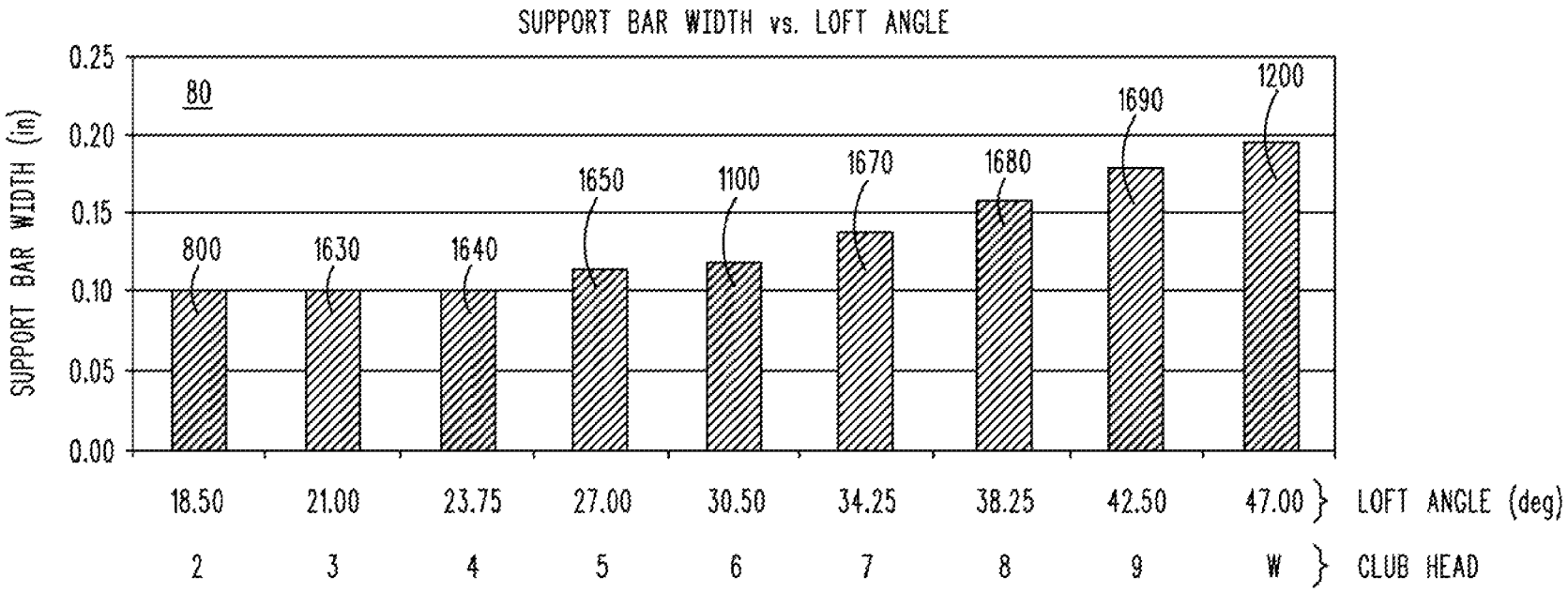
FIG. 16 illustrates a chart of an exemplary relationship between support bar width relative to loft angle for the exemplary club head set of FIGS. 8-15.

The variation of support bar width relative to loft angle is summarized in FIG. 16 for the exemplary club head set 80. In the present example, club head set 80 comprises club head 800 as a 2-iron head, club head 1630 as a 3-iron head, club head 1640 as a 4-iron head, club head 1650 as a 5-iron head, club head 1100 as a 6-iron head, club head 1670 as a 7-iron head, club head 1680 as an 8-iron head, club head 1690 as a 9-iron head, and club head 1200 as a wedge-iron head. As can be appreciated from FIG. 16, the support bar width attribute is varied incrementally as the loft angle increases from one club head to the next in club head set 80. As a result, the support bar width for a club with a higher loft angle is greater than or equal to the support bar width for a club with a lower loft angle. There can be examples, however, where the characteristic and/or attribute of the one or more support bars can be incrementally varied for each increment in loft angle, such that the support bar width for a club with higher loft angle is greater than the support bar width for any club with a lower loft angle.

Figure 22:
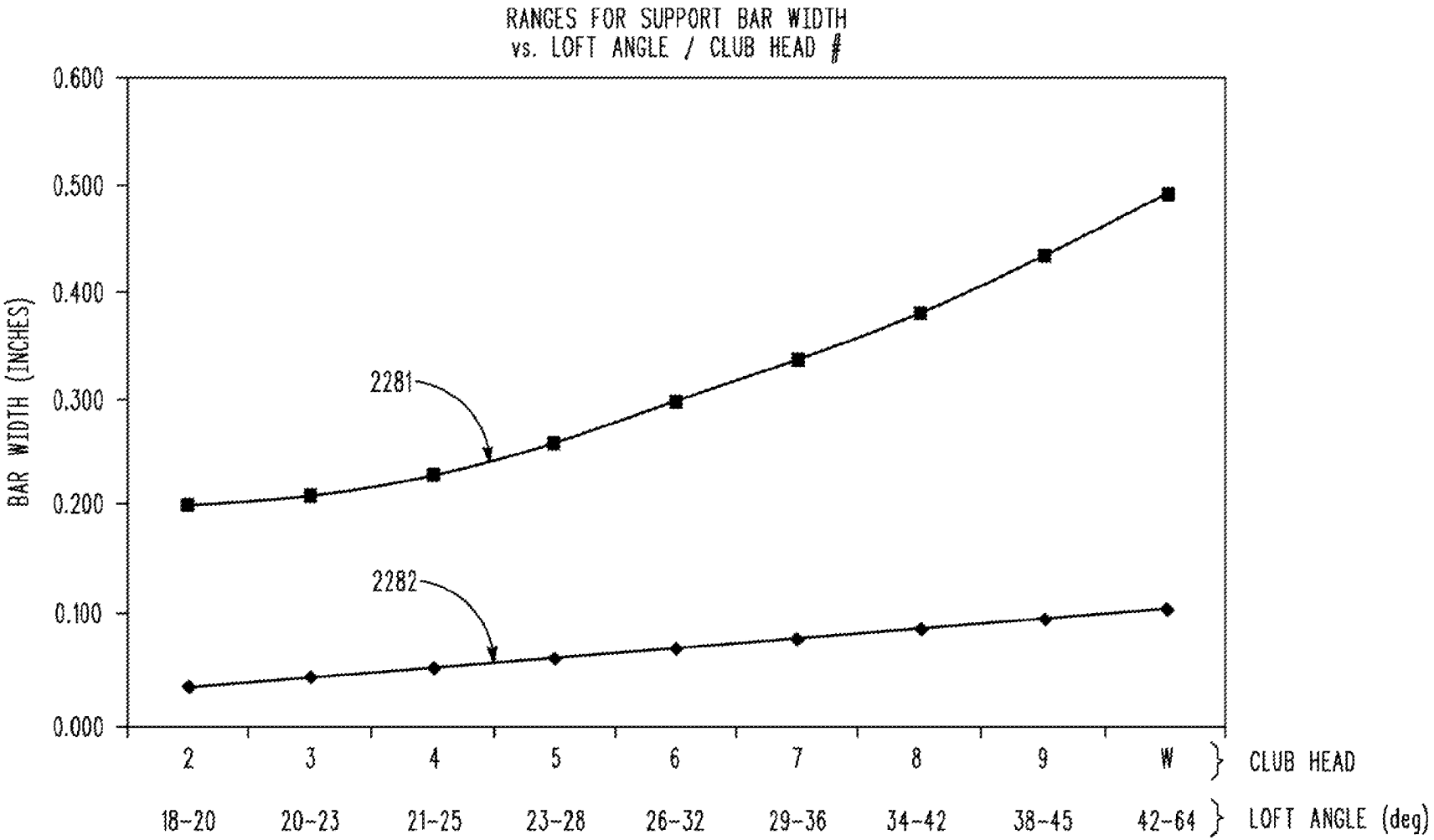
FIG. 22 illustrates a chart with sample ranges for relationships between the support bar widths and the loft angles/club head numbers.

Skipping ahead in the figures, as seen in FIG. 22, relationships between support bar width and loft angle/club head number may lie within one or more ranges. For example, club head set 2281 comprises club heads with thicker support bar widths that vary from club head to club head as indicated in FIG. 22. Similarly, in another example, club head set 2282 comprises club heads with thinner support bar widths that vary from club head to club head as also indicated in FIG. 22. Other examples or rates of variation are also possible for other club head sets.

In the same or other examples, support bar widths may vary within certain ranges, depending on the loft angle and/or the club head number, for club heads of one or more club head sets. For instance:

For a 2-iron head, the loft angle can comprise approximately 18 degrees to approximately 20 degrees, and the support bar width can comprise approximately 0.03 inches (0.75 millimeters) to approximately 0.2 inches (5.1 millimeters);

For a 3-iron head, the loft angle can comprise approximately 20 degrees to approximately 23 degrees, and the support bar width can comprise approximately 0.04 inches (1.0 millimeters) to approximately 0.21 inches (5.3 millimeters);

For a 4-iron head, the loft angle can comprise approximately 21 degrees to approximately 25 degrees, and the support bar width can comprise approximately 0.05 inches (1.3 millimeters) to approximately 0.23 inches (5.8 millimeters);

For a 5-iron head, the loft angle can comprise approximately 23 degrees to approximately 28 degrees, and the support bar width can comprise approximately 0.06 inches (1.5 millimeters) to approximately 0.26 inches (6.6 millimeters);

For a 6-iron head, the loft angle can comprise approximately 26 degrees to approximately 32 degrees, and the support bar width can comprise approximately 0.07 inches (1.8 millimeters) to approximately 0.30 inches (7.6 millimeters);

For a 7-iron head, the loft angle can comprise approximately 29 degrees to approximately 36 degrees, and the support bar width can comprise approximately 0.08 inches (2.0 millimeters) to approximately 0.34 inches (8.7 millimeters);

For a 8-iron head, the loft angle can comprise approximately 34 degrees to approximately 42 degrees, and the support bar width can comprise approximately 0.09 inches (2.3 millimeters) to approximately 0.39 inches (9.8 millimeters);

For a 9-iron head, the loft angle can comprise approximately 38 degrees to approximately 45 degrees, and the support bar width can comprise approximately 0.10 inches (2.5 millimeters) to approximately 0.44 inches (11.2 millimeters); and/or For a wedge-iron head, the loft angle can comprise approximately 42 degrees to approximately 64 degrees, and the support bar width can comprise approximately 0.11 inches (2.8 millimeters) to approximately 0.50 inches (12.7 millimeters).

In the same or other embodiments, one or more other characteristics or attributes of the support bars can vary, besides, instead of, or in addition to the support bar width, in a fashion similar to that described above for the support bar width. For example, in one embodiment, the other characteristic or attribute can comprise a support bar thickness, measured from the back face, that may be incrementally varied according to the loft angle. In such an example, a thickness of support bars 1261 of club head 1200 in FIG. 12 could be thicker than a thickness of support bars 1161 of club head 1100 in FIG. 11, and/or a thickness of support bars 1161 of club head 1100 in FIG. 11 could be thicker than a thickness of support bars 861 of club head 800 in FIG. 10.

Figure 17:
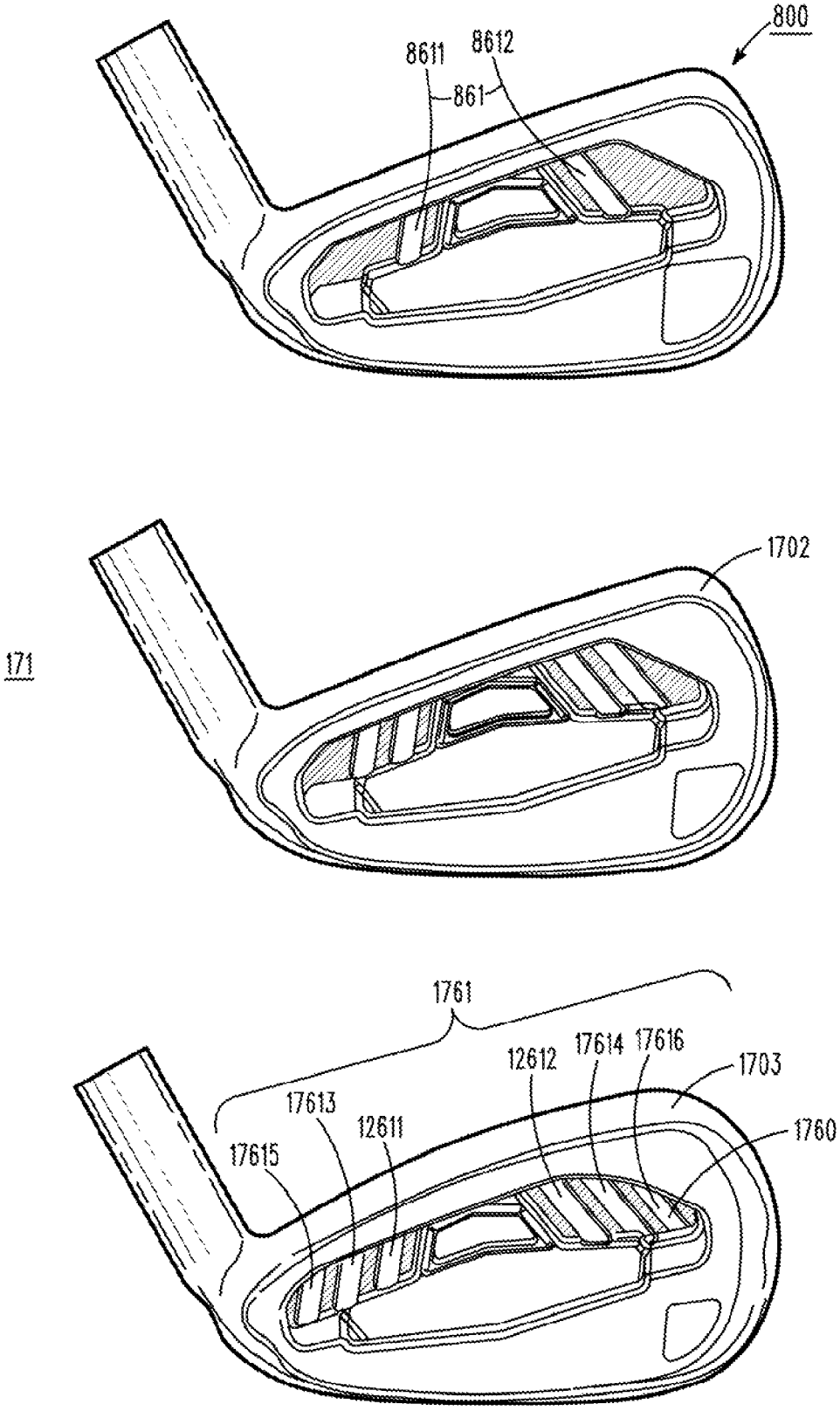
FIG. 17 illustrates several club heads of a club head set with varying characteristics according to an embodiment of the golf clubs and methods of manufacture described herein.

In the same or another embodiment, the other characteristic or attribute can comprise a total number of support bars that may be incrementally varied according to the loft angle. Such an embodiment is illustrated in FIG. 17 for club head set 171, comprising club head 800, club head 1702 similar to club head 1100, and club head 1703 similar to club head 1200. In the example of FIG. 17, the loft angle for club head 1703 is greater than the loft angle for club head 1702, and the loft angle for club head 1702 is greater than the loft angle for club head 1701, such that the total number of support bars for club head 1703 is greater than the total number of support bars for club head 1702, and the total number of support bars for club head 1702 is greater than the total number of support bars for club head 1701. In one example, the support bar width, thickness, and angle remains the same for each of the support bars in a single club head. In other examples, more than one characteristic or attribute is varied per club head, and/or support bars within a single club head can have different widths, thicknesses, and/or angles.

The incorporation of support bars at the back faces of the club heads of club head sets as described above can be beneficial for several reasons. For example, the placement of support bars proximate to a center region at back face of a club head can increase support for the front face and/or face plate to better withstand stresses associated with impacts to golf balls. Such additional support can be useful in situations where the face plate thickness has been minimized for weight savings and/or weight redistribution considerations.

In the case of short irons, such as wedge heads like club head 1200 in FIGS. 12 and 15, the placement of wider and/or thicker support bars such as support bars 1261 at back face 1260 just opposite to front face 1550 can have the effect of shifting the center of gravity of club head 1200 towards the front thereof. This shift can reduce a gear effect between front face 1550 and a golf ball, thereby limiting spin imparted onto the golf ball upon impact with front face 1550 for better trajectory control. In addition, better distance control and repeatability may be gained as a result of added face stability and reduced face deflection during impact due to the wider and/or thicker support bars. In some examples, similar results can also be achieved by having an increased number of support bars, such as in the case of support bars 1761 of club head 1703 in FIG. 17.

In the case of long irons, such as 2-irons like club head 800 in FIGS. 8, 10, and 13, the moment of inertia of the club head can be increased for better control by decreasing the relevant characteristic or attribute of the support bars, whether it be support bar width, support bar thickness, and/or total number of support bars, such that more of the mass of club head 800 can be distributed towards the edges of front face 950 of club head 800 for increased moment of inertia. In addition, longer and/or more penetrating flight paths may be achieved due to the decreased relevant support bar characteristic by permitting greater flexure of the front face and/or face plate of the club head.

Furthermore, in cases such as depicted for club head set 80, because the support bars are visible at the back face of the club heads, an increase in user confidence may be achieved for users that can appreciate the enhanced support, strength, and control features that the arrangement of support bars provides.

Backtracking to FIG. 8, club head 800 also is shown as comprising lower toe insert 895 in addition to insert 885 and related cavity 1080 (FIG. 10). There can be, however, other embodiments comprising insert 885 and cavity 1080 without lower toe insert 895, and/or other embodiments comprising lower toe insert 895 without insert 885 and cavity 1080. Similar variations in features can be extended for other clubs of respective club head sets. For example, all or part of the club heads of club head set 80 may comprise lower toe inserts similar to lower toe insert 895, in addition to inserts and related cavities similar to insert 885 and related cavity 1080. There can also be embodiments where all or a portion of the club heads of a club head set may comprise inserts and related cavities similar to insert 885 and related cavity 1080, but may lack lower to inserts similar to lower toe insert 895. There can also be embodiments where all or a portion of the club heads of a club head set may comprise lower toe inserts similar to lower toe insert 895, but may lack inserts and related cavities similar to insert 885 and related cavity 1080.

Continuing with FIG. 8, lower toe insert 895 can be similar to weight 195 of club head 100 (FIGS. 1, 4) and, in the present example, also comprises a weight. Lower toe insert 895 is located at lower toe section 811 of back portion 802, and although club head 800 comprises perimeter weight 875, lower toe insert 895 is located only at lower toe section 811. In the present example, lower toe insert 895 comprises a tungsten material and a specific gravity of approximately 10 g/cm$^3$ In the present example, the other club heads of club head set 80 also comprise corresponding lower toe inserts similar to lower toe insert 895.

In some examples, lower toe insert 895 and/or other similar inserts can be located at lower toe portion 811 to effect a redistribution of mass of club head 800. For example, lower toe insert 895 can be configured to shift the mass distribution of club head 800 away from center region 861 and towards toe region 810 and/or lower toe section 811 to thereby increase the moment of inertia of club head 800. In the same or other examples, lower toe insert 895 can be configured to counterbalance the mass of hosel 805 at the heel or upper heel portion of club head 800. By having hosel 805 and lower toe insert 895 substantially opposite each other, the distribution of mass of club head 800 can be shifted towards the ends of club head 800 to thereby increase its moment of inertia and forgiveness factor. In the same or other examples, the dimensions, location, and/or mass of lower toe insert 895 can be configured such as to adjust or align the center of gravity of club head 800 at a desired location relative to heel region 820 and/or toe region 810.

As previously described, the loft angles of the club heads of club head set 80 are incrementally varied across the two or more club heads in the present example. In addition, characteristics or dimensions of the corresponding lower toe inserts are also varied across the two or more club heads of club head set 80 in relation with the variation in loft angle. For instance, where each lower toe insert comprises two characteristics, the two characteristics can be inversely varied relative to each other for each lower toe insert across the club heads of club head set 80 as the loft angle is varied. As an example, a varied characteristic of the lower toe inserts may be incrementally varied, while an inverse characteristic of the lower toe inserts is decrementally varied as the loft angle changes.

The variation in characteristics relative to loft angle can be further appreciated as presented in FIGS. 10-15, for the example of club head set 80, via club heads 800, 1100, and 1200. As seen in FIGS. 13-15, loft angle 1555 of club head 1200 is greater than loft angle 1455 of club head 1100, which in turn is greater than loft angle 955 of club head 800. Furthermore, for the present embodiment, as loft angles increase from club head to club head, lower toe thicknesses, as measured along respective depth axes of the club heads, tend to increase from club head to club head. In the same and other embodiments, the lower toe thickness of a club head can be related and/or defined by a sole of the club head. As an example, lower toe thickness 15954 (FIG. 15) of club head 1200 is greater than lower toe thickness 14954 (FIG. 14) of club head 1100, which in turn is greater than lower toe thickness 13954 (FIG. 13) of club head 800. Similarly, lower toe thickness 13954 of club head 800 is defined by, and comprises a portion of, a thickness of sole 13001 (FIG. 13), while lower toe thickness 15954 of club head 1200 is defined by, and comprises a portion of, a thickness of sole 15001 (FIG. 15), such that the thickness of sole 15001 is greater than the thickness of sole 13001.

In the embodiment of club head set 80, the varied characteristic can be a depth of the lower toe insert, while the inverse characteristic can be an area of the lower toe insert. As an example, for club head 800, insert depth 13952 (FIG. 13) of lower toe insert 895 is measured along depth axis 13953, where depth axis 13953 traverses minimum distance point 13955 between lower toe insert 865 and front face 950, where insert area 8951 (FIGS. 8, 10) represents a cross-sectional area of lower toe insert 895 substantially perpendicular to depth axis 13953 and/or where depth axis 13953 is substantially parallel to sole 13001 (FIG. 13) and/or is substantially perpendicular to shaft bore axis 806. Similarly, for club head 1100, insert depth 14952 (FIG. 14) is measured along depth axis 14953, where depth axis 14953 traverses minimum distance point 14955 between lower toe insert 1195 and front face 1450, where insert area 11951 (FIG. 11) represents a cross-sectional area of lower toe insert 1195 substantially perpendicular to depth axis 14953, and/or where depth axis 14953 is substantially parallel to sole 14001 (FIG. 14) and/or is substantially perpendicular to shaft bore axis 1406. As another example, for club head 1200, insert depth 15952 (FIG. 15) is measured along depth axis 15953, where depth axis 15953 traverses minimum distance point 15955 between lower toe insert 1295 and front face 1550, and where insert area 12951 (FIG. 12) represents a cross-sectional area of lower toe insert 1295 substantially perpendicular to depth axis 15953, and/or where depth axis 15953 is substantially parallel to sole 15001 (FIG. 15) and/or is substantially perpendicular to shaft bore axis 1506. In such examples, where the varied characteristic of lower toe insert depth (13952, 14952, 15952) increases from club head 800 to club head 1200, the inverse characteristic of lower toe area (8991, 11951, 12951) decreases from club head 800 to club head 1200. In a different embodiment, the lower toe insert depth (13952, 14952, 15952) increases as the loft angle (955, 1455, 1555) increases.

In the same or other embodiments, one of the characteristics or dimensions that vary can be a distance between a center of gravity of the lower toe insert and the front face of respective club head. For instance, a distance between the center of gravity of a lower toe insert and the front face of a corresponding lower-lofted club head can be greater than a distance between the center of gravity of a lower toe insert and the front face of a corresponding higher-lofted club head. As an example, distance 13957 between center of gravity 13956 of lower toe insert 895 and front face 950 of club head 800 (FIG. 13) is greater than distance 14957 between center of gravity 14956 of lower toe insert 1195 and front face 1450 of club head 1100 (FIG. 14), which in turn is greater than distance 15957 between center of gravity 15956 of lower toe insert 1295 and front face 1550 of club head 1200 (FIG. 15). In such examples, where the varied characteristic of lower toe insert depth (13952, 14952, 15952) increases from club head 800 to club head 1200, the inverse characteristic of center of gravity distance (13957, 14957, 15957) decreases from club head 800 to club head 1200. In a different embodiment, the center of gravity distance (13957, 14957, 15957) decreases as the loft angle (955, 1455, 1555) increases.

The club head variations described above based on loft angle can permit the insert depths of the lower toe inserts to vary. For example, insert depth 15952 (FIG. 15) of insert 1295 is greater than insert depth 14952 (FIG. 14) of insert 1195, which in turn is greater than insert depth 13952 (FIG. 13) of lower toe insert 895. Furthermore, distances between the lower toe inserts and the respective club head front faces can vary accordingly. In the present example of club head 80, insert-to-face distance 1360 (FIG. 13) of club head 800 is of approximately 0.281 inches (7.14 millimeters), which is greater than insert-to-face distance 1460 (FIG. 14) of club head 1100 at approximately 0.233 inches (5.92 millimeters), which, in turn, is greater than insert-to-face distance 1560 (FIG. 15) of club head 1200 at approximately 0.195 inches (4.95 millimeters).

Such variation in the insert depths of the lower toe inserts, in the distances between the lower toe inserts and their respective club head front faces, and/or in the distances between the center of gravity of the lower toe inserts and their respective club head front faces, can vary mass distribution for the club heads, thereby permitting the adjustment of certain qualities of the club heads.

For example, by having shallower insert depths and/or larger insert-to-face distances for lower-lofted club heads, the center of gravity of such club heads can be moved away from the respective club head front faces, thereby increasing club head dynamic loft and imparted spin such as to allow higher launch angles and/or flight trajectories for impacted balls. Conversely, by having deeper insert depths and/or shallower insert-to-face distances for higher-lofted club heads, the center of gravity of such club heads can be moved closer to the respective club head front faces, thereby allowing for more penetrating flight paths for impacted balls.

The variation in insert depth described above could lead to a variation in mass of the different lower toe inserts of the club heads. To counteract such mass variation, and the effects it could have on other qualities of the club heads, like the counterbalancing of respective hosels with respective lower toe inserts, other characteristics or dimensions of the lower toe inserts can be varied inversely with respect to the variation in insert depth. For example, as the insert depths of the lower toe inserts increase, an area of the lower toe inserts can be decreased, such that all lower toe inserts comprise substantially similar masses. In some embodiments, a mass of each of the lower toe inserts of club head set 80 comprises approximately 10.25 grams. In the same or other examples, such mass may be of approximately 5 grams to approximately 50 grams. In the example of club head set 80, as insert depths vary by increasing from insert depth 13952 (FIG. 13) to insert depth 14952 (FIG. 14), and from insert depth 14952 to insert depth 15952 (FIG. 15), corresponding areas for the inserts inversely vary by decreasing from insert area 8951 (FIG. 10) to insert area 11951 (FIG. 11), and from insert area 11951 (FIG. 11) to insert area 12951 (FIG. 12).

Figure 19:
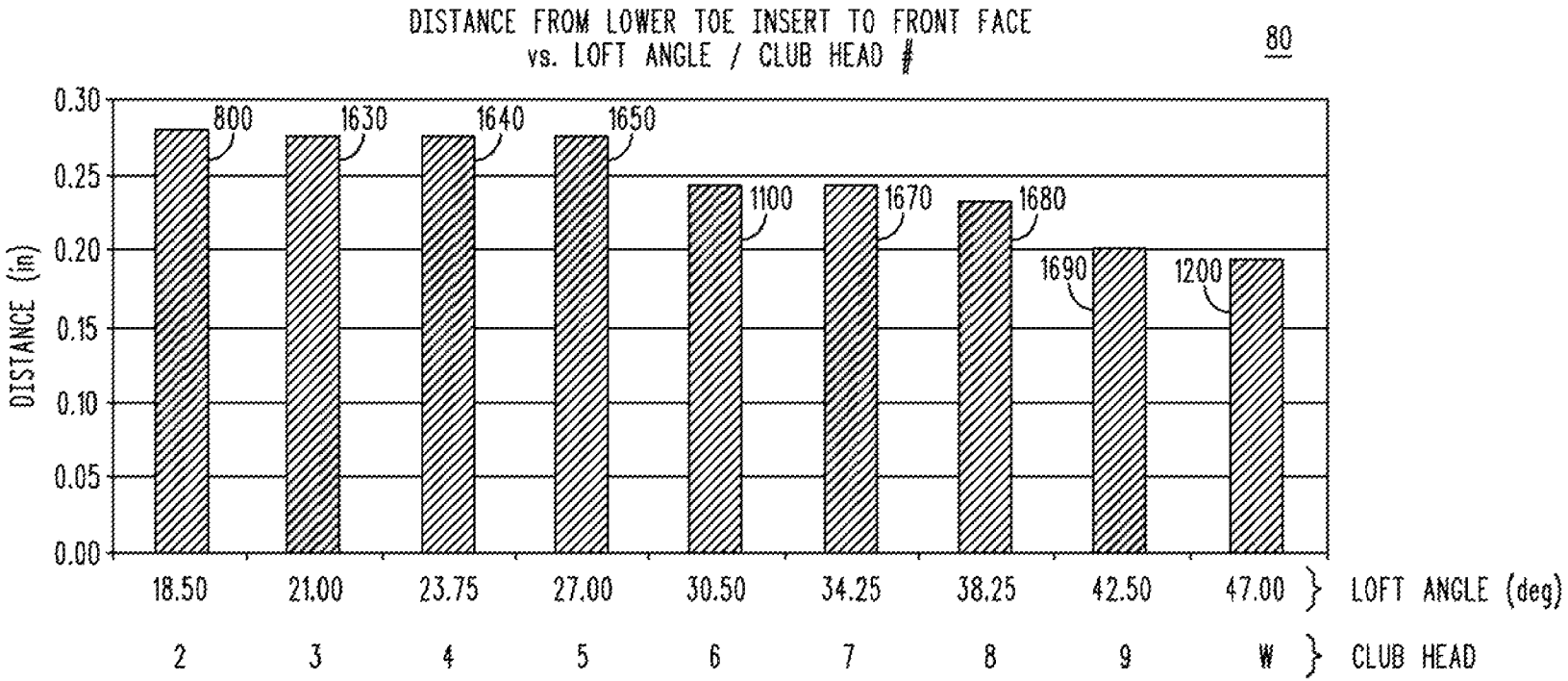
FIG. 19 illustrates a chart of exemplary relationship between loft angle and distances between lower toe inserts to front faces for the exemplary club heads of FIGS. 8-18 according to an embodiment of the golf clubs and methods of manufacture described herein.
Figure 23:
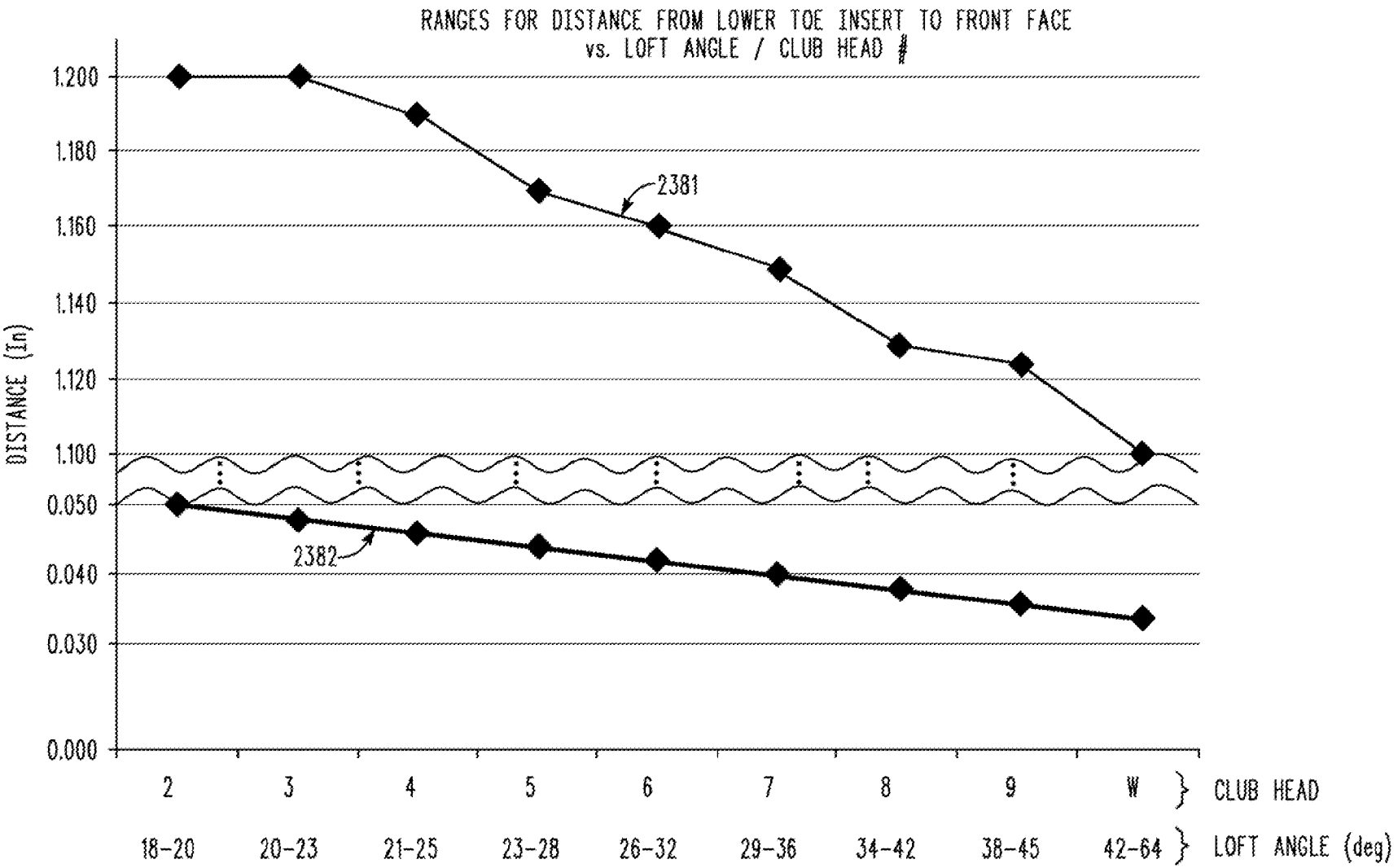
FIG. 23 illustrates a chart with sample ranges for relationships between the distances from the lower toe inserts to the club head front faces and the loft angles/club head numbers.

FIG. 19 illustrates an exemplary relationship between loft angle and the distances between lower toe inserts to front faces for the embodiment of club head set 80. Skipping ahead in the figures, as seen in FIG. 23, relationships between front-face-to-lower-toe-weight distances and loft angle/club head number may lie within one or more ranges. For example, club head set 2381 comprises club heads with longer front-face-to-lower-toe-weight distances that vary from club head to club head as indicated in FIG. 23. Similarly, in another example, club head set 2382 comprises club heads with shorter front-face-to-lower-toe-weight distances that vary from club head to club head as also indicated in FIG. 23. The club heads of club head set 2381 can have soles that are generally wider, from front to back of the club head, than the soles of the club heads of club head set 2382. Other examples or rates of variation are also possible for other club head sets.

In the same or other examples, front-face-to-lower-toe-weight distances may vary within certain ranges, depending on the loft angle and/or the club head number, for club heads of one or more club head sets. For instance:

- A 2-iron front-face-to-lower-toe-weight distance can comprise approximately 0.050 inches (1.27 millimeters) to approximately 1.2 inches (28.08 millimeters);
- A 3-iron front-face-to-lower-toe-weight distance can comprise approximately 0.048 inches (1.22 millimeters) to approximately 1.2 inches (28.08 millimeters);
- A 4-iron front-face-to-lower-toe-weight distance can comprise approximately 0.046 inches (1.17 millimeters) to approximately 1.19 inches (27.85 millimeters);
- A 5-iron front-face-to-lower-toe-weight distance can comprise approximately 0.044 inches (1.12 millimeters) to approximately 1.17 inches (27.38 millimeters);
- A 6-iron front-face-to-lower-toe-weight distance can comprise approximately 0.042 inches (1.07 millimeters) to approximately 1.16 inches (27.14 millimeters);

A 7-iron front-face-to-lower-toe-weight distance can comprise approximately 0.040 inches (1.02 millimeters) to approximately 1.15 inches (26.91 millimeters);

A 8-iron front-face-to-lower-toe-weight distance can comprise approximately 0.038 inches (0.97 millimeters) to approximately 1.13 inches (26.44 millimeters);

A 9-iron front-face-to-lower-toe-weight distance can comprise approximately 0.036 inches (0.91 millimeters) to approximately 1.125 inches (26.33 millimeters); and/or A wedge-iron front-face-to-lower-toe-weight distance can comprise approximately 0.034 inches (0.86 millimeters) to approximately 1.10 inches (25.74 millimeters).

Backtracking to FIGS. 13-15, to simplify matters, relationships between higher-lofted club heads and lower-lofted club heads, with respect to their lower-toe inserts, will be described below by referencing club heads 800 and 1200 of club head set 80. Relationships between other club heads may be extrapolated or interpolated based on the description below of club heads 800 and 1200.

In the present example of club head set 80, lower toe insert 895 of club head 800, and lower toe insert 1295 of club head 1200, comprise weights with substantially similar masses. In addition, dimensions of lower toe inserts 895 and 1295 correspond to each other, such that insert depth 13952 (FIG. 13) of lower toe insert 895 corresponds to insert depth 15952 (FIG. 15) of lower toe insert 1295, and insert area 8951 (FIG. 10) of lower toe insert 895 corresponds to insert area 12951 (FIG. 12) of lower toe insert 1295. Insert areas 8951 and 12951 can represent cross-sectional areas and/or back-end areas of their respective lower toe inserts in the present or other embodiments. In the present example, because insert depth 15952 of lower toe insert 1295 is greater than insert depth 13952 of lower toe insert 895, insert area 8951 of lower toe insert 895 is greater than insert area 12951 of lower toe insert 1295. As a result, the insert area and insert depth dimensions are inversely varied relative to each other.

Furthermore, as seen in FIGS. 13 and 15, insert-to-face distance 1560 between lower toe insert 1595 and front face 1550 is greater than insert-to-face distance 1360 between lower toe insert 895 and front face 950. In the present example, insert-to-face distance 1560 comprises a shortest distance between front face 1550 and lower toe insert 1295, while insert-to-face distance 1360 comprises a shortest distance between front face 950 and lower toe insert 895. Such relationships described above between lower toe inserts (895, 1295) and front faces (950, 1550) of respective club heads 800 and 1200 define respective distributions of mass such that a center of gravity of club head 1200 can be closer to front face 1550 than a center of gravity of club head 800 is to front face 950.

In the present examples, both lower toe inserts 895 and 1295 are visible at their respective lower toe sections of club heads 800 and 1200. In some examples, such visibility of the lower toe inserts may inspire user confidence for users that can appreciate the enhanced performance and control features that the arrangement of the respective lower toe inserts provides. There can be other embodiments, however, where lower toe inserts may not be visible. For example, the interface between the lower toe insert 895 and lower toe section 811 may blend or otherwise become indiscernible after machining or polishing steps.

In the example of club head set 80, club head 800 comprises perimeter weight 875 at a periphery of back portion 802, and club head 1200 comprises perimeter weight 1275 at a periphery of pack portion 1202. Perimeter weight 875 comprises a cavity at lower toe section 811, where lower toe insert 895 is located. Similarly, perimeter weight 1275 comprises a cavity at lower toe section 1211, where lower toe insert 1295 is located. As a result, the lower toe inserts can be integrated with their respective perimeter weights while still being located only at their respective lower toe sections. In addition, in the present example, lower toe insert 1295 is incompatible with the cavity of lower toe section 811 in club head 800, while lower toe insert 895 is incompatible with the cavity of lower toe section 1211 in club head 1200.

Figure 20:
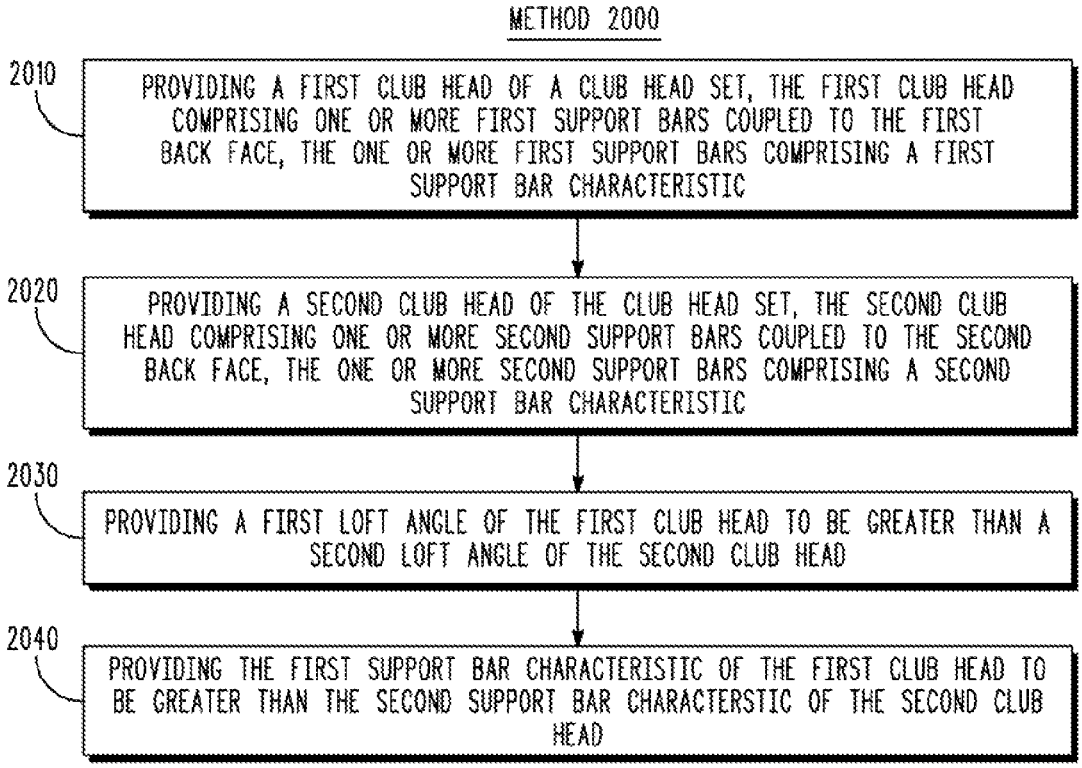
FIG. 20 illustrates a flowchart of a method for providing a club head set similar to the club head sets described for FIGS. 8-19.

Forging ahead, FIG. 20 illustrates a flowchart of method 2000 for providing a club head set. In some examples, the club head set of method 2000 can be similar to club head set 80 of FIGS. 8-16 and 18-19, and/or to club head set 171 of FIG. 17.

Block 2010 of method 2000 comprises providing a first club head of a club head set, the first club head comprising one or more first support bars coupled to the first back face, the one or more first support bars comprising a first support bar characteristic. In some examples, the first club head can be similar to club head 1200 (FIGS. 12, 15, 16, 19), and the one or more first support bars can be similar to support bars 1261 (FIG. 12) coupled to back face 1260, or to support bars 1761 (FIG. 17) coupled to back face 1760. In the same or other examples, the first support bar characteristic can comprise a support bar width, a support bar thickness, and/or a total number of support bars.

Block 2020 of method 2000 comprises providing a second club head of the club head set, the second club head comprising one or more second support bars coupled to the second back face, the one or more second support bars comprising a second support bar characteristic. In some examples, the second club head can be similar to club head 800 (FIGS. 8-10, 13, 16-19), and the one or more first support bars can be similar to support bars 861 (FIGS. 8, 12, 17) coupled to back face 860. In the same or other examples, the second support bar characteristic can comprise a second support bar width, a second support bar thickness, and/or a second total number of support bars.

Block 2030 of method 2000 comprises providing a first loft angle of the first club head to be greater than a second loft angle of the second club head. In some examples, the first loft angle can be similar to loft angle 1555 (FIG. 15) of club head 1200, and the second loft angle can be similar to loft angle 955 (FIGS. 9, 13) of club head 800.

Block 2040 of method 2000 comprises providing the first support bar characteristic of the first club head to be greater than the second support bar characteristic of the second club head. As a result, the support bar characteristic would be greater for the club head having a greater loft angle. As an example, the first support bar characteristic for club head 1200 in FIG. 12 comprises a support bar width of support bars 1261, while the second support bar characteristic for club head 800 in FIG. 10 comprises a support bar width of support bars 861. As can be seen by comparing FIGS. 8 and 12, and by referring to the graph in FIG. 16, the support bar width for support bars 1261 (FIG. 12) is greater than the support bar width for support bars 861 (FIG. 10) in the example of golf club set 80. In the same or another example, where the support bar characteristic comprised a support bar thickness, the support bar thickness for support bars 1261 (FIG. 12) can be thicker than the support bar thickness for support bars 861 (FIG. 10). In the example of FIG. 17, the support bar characteristics comprise a total number of support bars and, as can be seen by comparing club head 1703 against club head 800 in FIG. 17, the total number of support bars 1761 in club head 1703 comprises support bars 12611-12612 and 17613-17616, and is thus greater than the total number of support bars 861 in club head 800, which comprises support bars 8611-8612.

There can be examples where the description above for method 2000 can be extended throughout the two or more club heads of the club head set. For example, method 2000 could comprise providing two or more club heads of the club head set, and providing a support bar characteristic for each of the two or more club heads, the support bar characteristic incrementally varying across the two or more club heads in accordance with loft angle variation across the two or more club heads. In such an example, the two or more club heads comprise the first and second club heads of blocks 2010 and 2020. In addition, the support bar characteristic for the first club head could comprise the first support bar characteristic described above with respect to blocks 2010 and 2040, while the support bar characteristic for the second club head could comprise the second support bar characteristic described above with respect to blocks 2020 and 2040. In the same or other examples, providing the support bar characteristic for each of the two or more club heads can comprises incrementally varying the support bar characteristic across the two or more club heads for each incremental loft angle variation across the two or more club heads.

In some examples, method 2000 could comprise providing a hosel for a club head of the club head set, and providing a counterbalance weight located only at a lower toe section at a back portion of the club head to counterbalance the hosel. In some examples, a counterbalance weight can be provided for the first club head of block 2010, for the second club head of block 2020, and/or for several or all of the club heads of the golf club set of method 2000. In some examples, the counterbalance weight can be similar to lower toe insert 895 (FIGS. 8, 10, 13) and or to lower toe insert 1295 (FIGS. 12, 15).

There can also be examples of method 2000 where an insert can be provided and located in a cavity at a back portion of a club head. For instance, a first back portion of the first club head can further comprise a back wall extended between the heel and toe regions and a first cavity located between the first back face and the back wall. The first cavity can comprises a cavity heel zone, a cavity toe zone, a cavity center zone, a cavity inner wall located opposite the first back face, and a cavity outer wall located opposite the back wall. In addition, the cavity inner wall of the first cavity can be thicker, relative to the first front face, at the cavity heel and toe zones than at the cavity center zone. In some examples, the first cavity can be similar to cavity 1280 of club head 1200 (FIG. 12), which can also be similar to cavity 1080 of club head 800 (FIG. 10). Also, the first club head can further comprise a first insert comprising an insert heel zone, an insert toe zone and an insert center zone, where the first insert is configured to be at least partially housed in the first cavity, and each of the insert heel and toe zones are thinner than the insert center zone. The first insert can comprise an insert inner wall complementary to the cavity inner wall, such that the insert heel and toe zones are obtusely angled relative to each other along the insert inner wall and about the insert center zone, and/or such that the cavity inner wall is obtusely angled complementarily to the insert inner wall. In some examples, the first inset can be similar to insert 885, as described above for FIGS. 8, and 18. Such arrangements may beneficial, for example, to redistribute mass away from a center of the club head to augment the moment of inertia thereof, as described above with respect to insert 885 and cavity 1080 of club head 800 (FIGS. 8, 10).

In some examples, some of the blocks of method 2000 can be subdivided into one or more sub-blocks. For example, block 2010 can be subdivided into several sub-blocks as described above for providing different portions of the first club head, such as the cavity and the insert at the back portion thereof.

In the same or other examples, one or more of the different blocks of method 2000 can be combined into a single block or performed simultaneously, and/or the sequence of such blocks can be changed. For example, block 2030 can occur simultaneously with block 2010 for the first club head, and can occur simultaneously with block 2020 for the second club head. In addition, block 2040 can occur simultaneously with block 2030. In another example, all of the details of the first club head can be performed in a first block, and all of the details of the second club head can be performed in a second block.

There can also be examples where method 2000 can comprise further or different blocks. As an example, method 2000 can also comprise individual blocks similar to blocks 2010 and/or 2020 for each of the two or more club heads of the club head set of method 2000. Other variations can be implemented for method 2000 without departing from the scope of the present disclosure.

Figure 21:
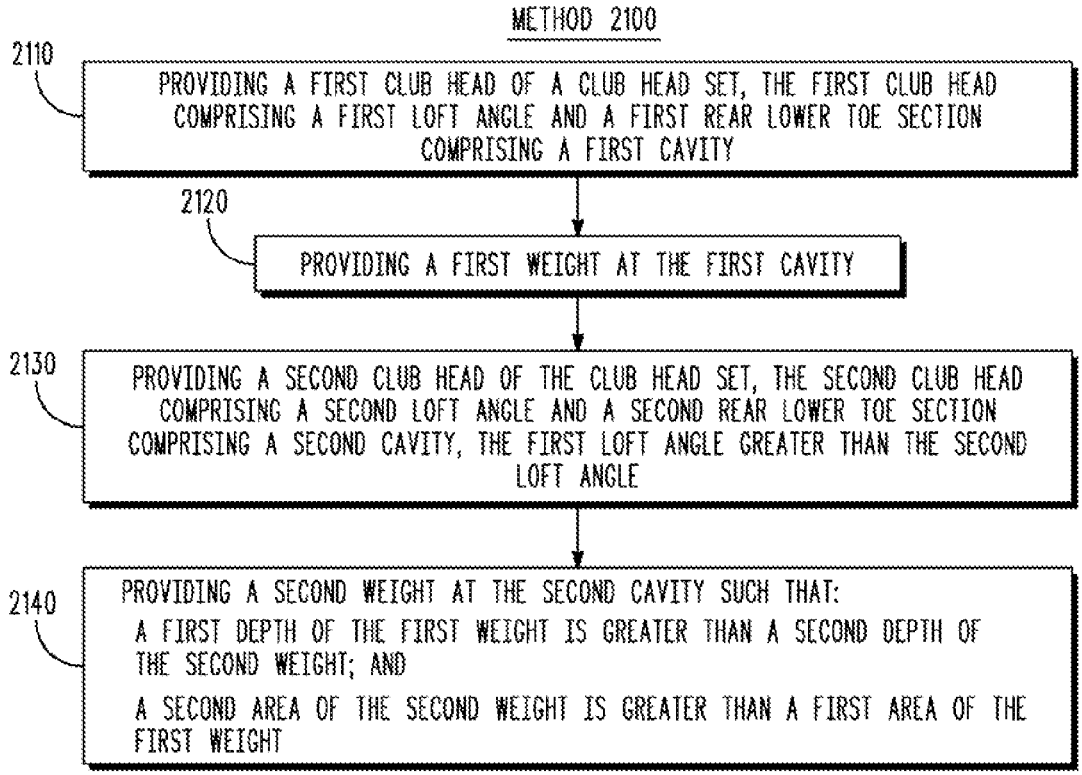
FIG. 21 illustrates a flowchart of another method for providing a club head set similar to the club head sets described for FIGS. 8-19 according to an embodiment of the golf clubs and methods of manufacture described herein.

Moving on, FIG. 21 illustrates a flowchart of method 2100 for providing a club head set. In some examples, the club head set of method 2100 can be similar to club head set 80 of FIGS. 1-16 and 19, and/or to club head set 171 of FIG. 17.

Block 2110 of method 2100 comprises providing a first club head of a club head set, the first club head comprising a first loft angle and a first rear lower toe section comprising a first cavity. In some examples, the first club head can be similar to club head 1200 (FIGS. 12, 15, 16, 19), such that the first loft angle can be similar to loft angle 1555 (FIG. 15), and the first cavity can be similar to cavity 1596 at lower toe section 1211 of club head 1200 (FIG. 15).

Block 2120 of method 2100 comprises providing a first weight at the first cavity. In some examples, the first weight can be similar to lower toe insert 1295 at cavity 1596 of club head 1200 (FIG. 15).

Block 2130 of method 2100 comprises providing a second club head of the club head set, the second club head comprising a second loft angle and a second rear lower toe section comprising a second cavity, the first loft angle greater than the second loft angle. There can be examples where the second club head can be similar to club head 800 (FIGS. 8, 9, 10, 13, 17, 18), such that the second loft angle can be similar to loft angle 955 (FIGS. 9, 13), and the second cavity can be similar to cavity 1396 at lower toe section 811 of club head 800 (FIG. 13). In other examples, the second club head can be another club head of the club head set having a loft angle less than the loft angle of the first club head.

Block 2140 of method 2100 comprises providing a second weight at the second cavity, such that a first depth of the first weight is greater than a second depth of the second weight, and a second area of the second weight is greater than a first area of the first weight. There can be examples where the second weight can be similar to lower toe insert 895 at cavity 1396 of club head 800 (FIG. 13). In such examples, the first depth and the first area of the first weight can be respectively similar to insert depth 15952 (FIG. 15) and insert area 12951 (FIG. 12), while the second depth and the second area can be respectively similar to insert depth 13952 (FIG. 13) and insert area 8951 (FIG. 10), and as a result, insert depth 15952 of lower toe insert 1295 is greater than insert depth 3952 of lower toe insert 895, and insert area 8951 of lower toe insert 895 is greater than insert area 12951 of lower toe insert 1295.

There can be implementations where the relationship above between the first and second areas of the first and second weights can be achieved by varying respective lengths and widths of the first and second weights. For example, the a second length of the second weight can be made greater than a first length of the first weight, and/or a second width of the second weight can be made greater than a first width of the first weight. In the example of club head set 80, where area 8951 (FIG. 10) is defined by length 8952 and width 8953 of lower toe insert 895, and where area 12951 (FIG. 12) is defined by length 12952 and width 12953, area 8951 of lower toe insert 895 can be greater than area 12951 of lower toe insert 1295 as a result of length 8952 being greater than length 12952, and/or as a result of width 8953 being greater than width 12953. In the present example, length 8952 and width 8953 of lower toe insert 895 are substantially the similar to each other, measuring approximately 0.475 inches (12.06 millimeters), while length 12952 and width 12953 of lower toe insert 1295 are also substantially similar to each other, measuring approximately 0.425 inches (10.8 millimeters). The corresponding length and width of lower insert weight 1195 (FIG. 11) measure approximately 0.450 inches (11.43 millimeters). There can be other embodiments, however, where the length and area of a lower toe insert need not be substantially similar to each other.

In some embodiments, block 2140 of method 2100 can further comprise providing a second minimum distance from the second weight to the second front face to be greater than a first minimum distance from the first weight to the first front face. In the same or other embodiments, block 2140 can also comprise providing a center of gravity of the first club head to be closer to the first front face than what a center of gravity of the second club head is to the second front face. For example, the second minimum distance can be similar to insert-to-face distance 1560 between lower toe insert 1295 and front face 1550 of club head 1200 (FIG. 15), while the first minimum distance can be similar to insert-to-face distance 1360 between lower toe insert 895 and front face 950 of club head 800 (FIG. 13). In the same or other embodiments, such arrangement may allow the center of gravity of higher-lofted club heads, like club head 1200, to be closer to their respective front faces than the center of gravity of lower lofted club heads like club head 800.

There can also be examples of method 2100 where an insert can be provided for location in a cavity at a back portion of a club head of the club head set of method 2100, similar to as described above for method 2000 and/or with respect to cavities 1080 (FIGS. 10) and 1280 (FIG. 12) of club heads 800 and 1200, respectively, and inserts similar to insert 885 (FIG. 8, 18). For instance, the cavity inner wall of the cavity may be thinner at the cavity center zone than at the cavity heel and toe zones. Similarly, the insert center zone may be thicker than the insert heel and toe zones for said insert. Such arrangements may beneficial, for example, to redistribute mass away from a center of the club head to augment the moment of inertia thereof, as described above with respect to insert 885 and cavity 1080 of club head 800 (FIGS. 8, 10).

There also can be embodiments of method 2100 where the description above for can be extended throughout a portion or all of the two or more club heads of the club head set. For example, method 2100 could comprise providing two or more club heads of the club head set, and inversely varying the depth and area of the lower toe inserts as the loft angles of the respective club heads increase across the two or more club heads of the club head set.

In some examples, some of the blocks of method 2100 can be subdivided into one or more sub-blocks. For example, block 2110 can be subdivided into several sub-blocks as described above for providing different portions of the first club head, such as the cavity and the insert at the back portion thereof. As another example, block 2140 also can comprise providing a mass of the second weight to be substantially similar to a mass of the first weight. Similar provisions can also be made across method 2100 such that the masses of all lower toe inserts of the club head set are substantially similar to each other.

In the same or other examples, one or more of the different blocks of method 2100 can be combined into a single block or performed simultaneously, and/or the sequence of such blocks can be changed. For example, block 2110 can occur simultaneously with block 2120 for the first club head, and/or block 2130 can occur simultaneously with block 2140 for the second club head.

There can also be examples where method 2100 can comprise further or different blocks. As an example, method 2100 can also comprise individual blocks similar to blocks 2110 and/or 2120 for each of the two or more club heads of the club head set of method 2100. Other variations can be implemented for method 2100 without departing from the scope of the present disclosure.

Figure 24:
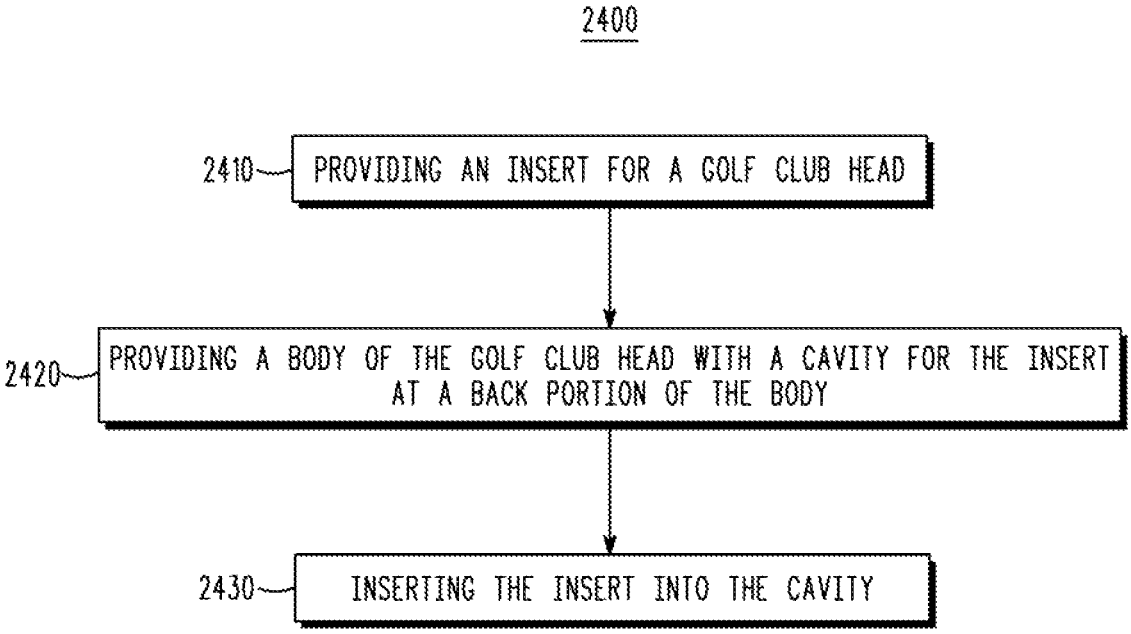
FIG. 24 illustrates a flowchart of a method for providing a club head similar to the club head shown in FIGS. 8-10, 13, and 18.

Skipping ahead, FIG. 24 illustrates a flowchart of method 2400 for providing a club head. In some examples, the club head of method 2400 can be similar to club head 800 as depicted for FIGS. 8-10 and 18.

Block 2410 of method 2400 comprises providing an insert for the golf club head of method 2400. In some examples, the insert can be similar to insert 185 (FIGS. 1, 3) and/or to insert 885 (FIGS. 8, 18). The insert can comprise heel, toe, and center zones, where the center zone is thicker than the heel and toe zones.

Block 2420 of method 2400 comprises providing a body of the golf club head with a cavity for the insert at a back portion of the body. Providing the body can comprise providing a back face and a back end at a back portion of the body, and providing the cavity between the back face and the back end. The cavity can comprise a cavity inner section adjacent to the back face, a cavity outer section opposite the back end, cavity heel and toe zones, and a cavity center zone thicker than the cavity heel and toe zones. In some examples, the body can be similar to body 801 of club head 800 (FIGS. 8, 18), the back face can be similar to back face 860 (FIGS. 8, 18), the back end can be similar to back end 870 (FIGS. 8, 18), and the cavity can be similar to cavity 1080 (FIGS. 10, 18).

Block 2430 of method 2400 comprises inserting the insert into the cavity of the body of the golf club head. In some examples, block 2430 can include adhering or otherwise coupling the insert to the cavity.

In some examples, some of the blocks of method 2400 can be subdivided into one or more sub-blocks. For example, block 2420 can be subdivided into several sub-blocks for providing different portions of the body of the club head.

In the same or other examples, one or more of the different blocks of method 2400 can be combined into a single block or performed simultaneously, and/or the sequence of such blocks can be changed. For example, block 2410 can occur simultaneously with or after block 2420 in some examples. In other examples one of blocks 2410 or 2420 may be optional. There can also be examples where method 2400 can comprise further or different blocks. Other variations can be implemented for method 2400 without departing from the scope of the present disclosure.

Although the club head sets with varying characteristics and related methods have been described with reference to specific embodiments, various changes may be made without departing from the spirit or scope of the disclosure. Additional examples of such options and other embodiments have been given in the foregoing description. Accordingly, the disclosure herein of embodiments of club head sets with varying characteristics and related methods is intended to be illustrative of the scope of the present disclosure and is not intended to be limiting. For example, in one embodiment, a golf club head may have one or more features of FIGS. 1-5, with or without the other features described with reference to FIGS. 1-5. In another example, the club head sets described above with respect to FIGS. 8-21 may comprise more or less club heads than those listed in FIGS. 16 and 19, and the loft angles, support bar characteristics, and/or lower toe insert weight attributes may differ from those in the examples of FIGS. 8-21 while still being related to each other. Other permutations of the different embodiments having one or more of the features of the various figures are likewise contemplated. It is intended that the scope of the club head sets with varying characteristics and related methods shall be limited only to the extent required by the appended claims.

The club head sets with varying characteristics and related methods discussed herein may be implemented in a variety of embodiments, and the foregoing discussion of these embodiments does not necessarily represent a complete description of all possible embodiments. Rather, the detailed description of the drawings, and the drawings themselves, disclose at least one preferred embodiment, and may disclose additional embodiments.

All elements claimed in any particular claim are essential to the club head sets with varying characteristics and related methods claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A club head set comprising:
- two or more club heads, each comprising:
  - a hosel having a hosel axis;
  - a loft angle;
  - a front face;
  - a back face opposite the front face;
  - one or more heelside support bars protruded from the back face, with at least one of the one or more heelside support bars comprising a maximum heelside support bar width; and
  - one or more toeside support bars protruded from the back face, with at least one of the one or more toeside support bars comprising a maximum toeside support bar width;
- wherein:
  - the loft angle is incrementally varied across the two or more club heads;
  - as the loft angle increases from club head to club head:
    - the maximum heelside support bar width increases at a first rate from club head to club head; and
    - the maximum toeside support bar width increases at the first rate from club head to club head;
  - for each of the two or more club heads, each of the one or more heelside and toeside support bars are non-parallel to the hosel axis;
  - the maximum toeside and heelside support bar widths increase for each increment in the loft angle; and
  - for each individual club head of the two or more club heads:
    - the maximum heelside support bar width is substantially equal to the maximum toeside support bar width; and
    - each of the one or more heelside support bars and each of the one or more toeside support bars extends from a club head perimeter weight to a top end of a weight insert cavity configured to receive a weight insert.

2. The club head set of claim 1, wherein:
- the two or more club heads comprise:
  - a first club head comprising:
    - one or more first heel support bars of the one or more heelside support bars of the first club head; and
    - one or more first toe support bars of the one or more toeside support bars of the first club head;
  - and
  - a second club head comprising:
    - one or more second heel support bars of the one or more heelside support bars of the second club head; and
    - one or more second toe support bars of the one or more toeside support bars of the second club head;
- the one or more heelside support bars comprise:
  - a heelside support bar characteristic comprising one of:
    - a maximum heelside support bar thickness; or
    - a maximum heelside support bar total number;
- the one or more first toeside support bars comprise:
  - a toeside support bar characteristic comprising one of:
    - a maximum toeside support bar thickness; or
    - a maximum toeside support bar total number;
- the loft angle of the first club head is greater than the loft angle of the second club head;
- the heelside support bar characteristic is greater for the one or more first heel support bars than for the one or more second heel support bars;
- the toeside support bar characteristic is greater for the one or more first toe support bars than for the one or more second toe support bars; and
- for each of the first and second club heads:
  - a magnitude of the heelside support bar characteristic equals a magnitude of the toeside support bar characteristic.

3. A club head set comprising:
- a first club head comprising:
  - a first loft angle;
  - a first front face; and
  - a first back portion comprising:
    - a first heel region comprising a first heel end;
    - a first toe region comprising a first toe end;
    - a first center region between the first heel and toe regions;
    - a first back face opposite the first front face and extended between the first heel and toe regions;
    - a first perimeter weight around a perimeter of the first back portion;
    - a first weight insert cavity at the first back face and configured to receive a first weight insert; and
    - one or more first support bars coupled to the first back face and comprising:

a first toe support bar at the first toe region and comprising a first maximum width measured between the first heel end and the first toe end; and a first heel support bar at the first heel region and comprising the first maximum width;

and a second club head comprising:

a second loft angle;

a second front face; and a second back portion comprising:

a second heel region comprising a second heel end;

a second toe region comprising a second toe end;

a second center region between the second heel and toe regions;

a second back face opposite the second front face and extended between the second heel and toe regions;

a second perimeter weight around a perimeter of the second back portion;

a second weight insert cavity at the second back face and configured to receive a second weight insert; and one or more second support bars coupled to the second back face and comprising:

a second toe support bar at the second toe region and comprising a second maximum width measured between the second heel end and the second toe end; and a second heel support bar at the second heel region and comprising the second maximum width;

wherein:

the first loft angle is greater than the second loft angle;

the first maximum width of the first heel and toe support bars is greater than the second maximum width of the second heel and toe support bars;

the first heel and toe support bars extend from the first perimeter weight to a top end of the first weight insert cavity; and the second heel and toe support bars extend from the second perimeter weight to a top end of the second weight insert cavity.

4. The club head set of claim 3, wherein:

each of the one or more first support bars comprises the first maximum width; and each of the one or more second support bars comprises the second maximum width.

5. The club head set of claim 3, wherein:

the first toe support bar comprises a first support bar maximum thickness;

the first heel support bar comprises the first support bar maximum thickness;

the second toe support bar comprises a second support bar maximum thickness;

the second heel support bar comprises the second support bar maximum thickness; and the first support bar maximum thickness of the first heel and toe support bars is greater than the second support bar maximum thickness of the second heel and toe support bars.

6. The club head set of claim 3, wherein:

a total number of the one or more first support bars is greater than a total number of the one or more second support bars.

7. The club head set of claim 3, wherein:

the one or more first support bars are visible at the first back face; and the one or more second support bars are visible at the second back face.

8. The club head set of claim 3, wherein:

the one or more first support bars are integral with the first back face; and the one or more second support bars are integral with the second back face.

9. The club head set of claim 3, wherein:

the first heel and toe support bars are equidistant from the first center region; and the second heel and toe support bars are equidistant from the second center region.

10. The club head set of claim 3, wherein:

the first back face is subdivided between a first top portion and a first bottom portion by a first horizontal axis;

the first heel and toe support bars each comprise a first angle, facing the first center region, of approximately 30 degrees to approximately 90 degrees from the first horizontal axis;

the second back face is subdivided between a second top portion and a second bottom portion by a second horizontal axis; and the second heel and toe support bars each comprise a second angle, facing the second center region, of approximately 30 degrees to approximately 90 degrees from the second horizontal axis.

11. The club head set of claim 3, wherein:

the first back face is subdivided between a first top portion and a first bottom portion by a first horizontal axis;

the first heel and toe support bars are angled from the first horizontal axis for convergence towards the first center region;

the second back face is subdivided between a second top portion and a second bottom portion by a second horizontal axis; and the second heel and toe support bars are angled from the second horizontal axis for convergence towards the second center region.

12. The club head set of claim 3, wherein:

the first club head further comprises a first hosel;

the first back portion of the first club head further comprises:

a first lower toe section; and a first counterbalance weight located only at the first lower toe section of the first back portion and configured to counterbalance the first hosel;

the second club head further comprises a second hosel; and the second back portion of the second club head further comprises:

a second lower toe section; and a second counterbalance weight located only at the second lower toe section of the second back portion and configured to counterbalance the second hosel.

13. The club head set of claim 3, wherein:

at least one of the first or second maximum width is approximately 0.75 millimeters to approximately 12.7 millimeters.

14. The club head set of claim 3, wherein:

the first club head comprises one of:

a 2-iron head, a 3-iron head, a 4-iron head, a 5-iron head, a 6-iron head, a 7-iron head, an 8-iron head, a 9-iron head, or a wedge head;

the second club head comprises a different one of:

the 2-iron head, the 3-iron head, the 4-iron head, the 5-iron head, the 6-iron head, the 7-iron head, the 8-iron head, the 9-iron head, or the wedge head;

the 2-iron head comprises:

a 2-iron loft angle of approximately 18 degrees to approximately 20 degrees; and a 2-iron support bar width of approximately 0.75 mm to approximately 5.1 mm;

the 3-iron head comprises:

a 3-iron loft angle of approximately 20 degrees to approximately 23 degrees; and a 3-iron support bar width of approximately 1.0 mm to approximately 5.3 mm;

the 4-iron head comprises:

a 4-iron loft angle of approximately 21 degrees to approximately 25 degrees; and a 4-iron support bar width of approximately 1.3 mm to approximately 5.8 mm;

the 5-iron head comprises:

a 5-iron loft angle of approximately 23 degrees to approximately 28 degrees; and a 5-iron support bar width of approximately 1.5 mm to approximately 6.6 mm;

the 6-iron head comprises:

a 6-iron loft angle of approximately 26 degrees to approximately 32 degrees; and a 6-iron support bar width of approximately 1.8 mm to approximately 7.6 mm;

the 7-iron head comprises:

a 7-iron loft angle of approximately 29 degrees to approximately 36 degrees; and a 7-iron support bar width of approximately 2.0 mm to approximately 8.7 mm;

the 8-iron head comprises:

a 8-iron loft angle of approximately 34 degrees to approximately 42 degrees; and a 8-iron support bar width of approximately 2.3 mm to approximately 9.8 mm;

the 9-iron head comprises:

a 9-iron loft angle of approximately 38 degrees to approximately 45 degrees; and a 9-iron support bar width of approximately 2.5 mm to approximately 11.2 mm;

and the wedge head comprises:

a wedge loft angle of approximately 42 degrees to approximately 64 degrees; and a wedge support bar width of approximately 2.8 mm to approximately 12.7 mm.

15. The club head set of claim 3, wherein:

the one or more first support bars are visible at the first back face;

the one or more second support bars are visible at the second back face;

the one or more first support bars are integral with the first back face;

the one or more second support bars are integral with the second back face;

the first back face is subdivided between a first top portion and a first bottom portion by a first horizontal axis;

the first heel and toe support bars are angled from the first horizontal axis for convergence towards the first center region;

the second back face is subdivided between a second top portion and a second bottom portion by a second horizontal axis; and the second heel and toe support bars are angled from the second horizontal axis for convergence towards the second center region.

16. The club head set of claim 15, wherein:

the first club head further comprises a first hosel;

the first back portion of the first club head further comprises:

a first lower toe section; and a first counterbalance weight located only at the first lower toe section of the first back portion and configured to counterbalance the first hosel;

the second club head further comprises a second hosel; and the second back portion of the second club head further comprises:

a second lower toe section; and a second counterbalance weight located only at the second lower toe section of the second back portion and configured to counterbalance the second hosel.

17. The club head set of claim 3, wherein:

the first club head further comprises a first hosel having a first hosel axis;

the second club head further comprises a second hosel having a second hosel axis;

the first toe support bar is non-parallel to the first hosel axis; and the second heel support bar is non-parallel to the second hosel axis.

18. The club head set of claim 3, wherein:

each of the one or more first support bars further comprises a first attribute;

each of the one or more second support bars further comprises a second attribute; and the first attribute of each of the one or more first support bars is greater than the second attribute of each of the one or more second support bars.

19. The club head set of claim 18, wherein:

the first attribute of the one or more first support bars comprises one of:

a first support bar thickness of the one or more first support bars; or a total number of the one or more first support bars; and the second attribute of the one or more second support bars comprises one of:

a second support bar thickness of the one or more second support bars; or a total number of the one or more second support bars.

20. The club head set of claim 18, wherein:

each of the one or more first support bars further comprises a third attribute;

each of the one or more second support bars further comprises a fourth attribute;

the third attribute of each of the one or more first support bars is greater than the fourth attribute of each of the one or more second support bars;

the first attribute of the one or more first support bars comprises:

a first support bar thickness of the one or more first support bars;

the second attribute of the one or more second support bars comprises:

a second support bar thickness of the one or more second support bars;

the third attribute of the one or more first support bars comprises:

a total number of the one or more first support bars; and the fourth attribute of the one or more second support bars comprises:

a total number of the one or more second support bars.

21. The club head set of claim 3, wherein:

the first heel and toe support bars are angled towards each other;

the first heel support bar comprises the first maximum width throughout its length;

the first toe support bar comprises the first maximum width throughout its length;

the second heel and toe support bars are angled towards each other;

the second heel support bar comprises the second maximum width throughout its length; and the second toe support bar comprises the second maximum width throughout its length.

22. The club head set of claim 3, wherein:

the second club head comprises a 6-iron head; and the first club head comprises an 8-iron head.

23. A method comprising:

providing a club head set, comprising:

providing a first club head of the club head set, the first club head comprising:

a first loft angle;

a first front face; and a first back portion comprising:

a first heel region comprising a first heel end;

a first toe region comprising a first toe end;

a first center region between the first heel and toe regions;

a first back face opposite the first front face and extended between the first heel and toe regions;

a first perimeter weight around a perimeter of the first back portion;

a first weight insert cavity at the first back face and configured to receive a first weight insert; and one or more first support bars coupled to the first back face and comprising:

a first toe support bar located at the first toe region and comprising a first maximum width measured between the first heel end and the first toe end; and a first heel support bar at the first heel region and comprising the first maximum width;

and providing a second club head of the club head set, the second club head comprising:

a second loft angle;

a second front face; and a second back portion comprising:

a second heel region comprising a second heel end;

a second toe region comprising a second toe end;

a second center region between the second heel and toe regions;

a second back face opposite the second front face and extended between the second heel and toe regions;

a second perimeter weight around a perimeter of the second back portion;

a second weight insert cavity at the second back face and configured to receive a second weight insert; and one or more second support bars coupled to the second back face and comprising:

a second toe support bar located at the second toe region and comprising a second maximum width measured between the second heel and the second toe end; and a second heel support bar at the second heel region and comprising the second maximum width;

wherein:

the first loft angle is greater than the second loft angle;

the first maximum width of the first heel and toe support bars is greater than the second maximum width of the second heel and toe support bars;

the first heel and toe support bars extend from the first perimeter weight to a top end of the first weight insert cavity; and the second heel and toe support bars extend from the second perimeter weight to a top end of the second weight insert cavity.

24. The method of claim 23, further comprising at least one of:

providing a maximum thickness of the one or more first support bars to be greater than a maximum thickness of the one or more second support bars; or providing a total number of the one or more first support bars to be greater than a total number of the one or more second support bars.

25. The method of claim 23, further comprising:

increasing, at a first rate, a maximum heelside support bar width from club head to club head of the club head set for each incremental loft angle variation; and increasing, at the first rate, a maximum toeside support bar width from club head to club head of the club head set for each incremental loft angle variation.

26. The method of claim 23, wherein:

providing the first club head further comprises:

providing a first hosel of the first club head; and providing a first counterbalance weight located only at a first lower toe section of the first back portion and configured to counterbalance the first hosel;

and providing the second club head further comprises:

providing a second hosel of the second club head; and providing a second counterbalance weight located only at a second lower toe section of the second back portion and configured to counterbalance the second hosel.

27. The method of claim 23, wherein:

the first heel and toe support bars are angled towards each other;

the first heel support bar comprises the first maximum width throughout its length;

the first toe support bar comprises the first maximum width throughout its length;

the second heel and toe support bars are angled towards each other;

the second heel support bar comprises the second maximum width throughout its length; and the second toe support bar comprises the second maximum width throughout its length.

* * * * *